US010074909B2

(12) United States Patent
Su et al.

(10) Patent No.: US 10,074,909 B2
(45) Date of Patent: Sep. 11, 2018

(54) OMNIDIRECTIONAL SINGLE-INPUT SINGLE-OUTPUT MULTIBAND/BROADBAND ANTENNAS

(71) Applicant: Laird Technologies, Inc., Earth City, MO (US)

(72) Inventors: Choon Chung Su, Perak (MY); Athanasios Petropoulos, Hudson, NH (US); Kok Jiunn Ng, Perak (MY)

(73) Assignee: Laird Technologies, Inc., Earth City, MO (US)

( * ) Notice: Subject to any disclaimer, the term of this patent is extended or adjusted under 35 U.S.C. 154(b) by 108 days.

(21) Appl. No.: 15/207,950

(22) Filed: Jul. 12, 2016

(65) Prior Publication Data

US 2017/0025766 A1 Jan. 26, 2017

(30) Foreign Application Priority Data

Jul. 21, 2015 (MY) ..... PI2015702366

(51) Int. Cl.

| | |
|---|---|
| ***H01Q 21/20*** | (2006.01) |
| ***H01Q 1/36*** | (2006.01) |
| ***H01Q 1/48*** | (2006.01) |
| ***H01Q 1/42*** | (2006.01) |
| ***H01Q 9/40*** | (2006.01) |
| ***H01Q 9/42*** | (2006.01) |
| ***H01Q 1/00*** | (2006.01) |

(52) U.S. Cl.

CPC ..... *H01Q 21/205* (2013.01); *H01Q 1/007* (2013.01); *H01Q 1/36* (2013.01); *H01Q 1/42* (2013.01); *H01Q 1/48* (2013.01); *H01Q 9/40* (2013.01); *H01Q 9/42* (2013.01)

(58) Field of Classification Search

CPC ..... H01Q 9/40; H01Q 21/20; H01Q 21/205

See application file for complete search history.

(56) References Cited

U.S. PATENT DOCUMENTS

| | | | | |
|---|---|---|---|---|
| 2,368,663 A | | 2/1945 | Kandoian | |
| 2,501,020 A | | 3/1950 | Barnes | |
| 4,074,268 A | * | 2/1978 | Olson | H01Q 3/28 342/399 |

(Continued)

FOREIGN PATENT DOCUMENTS

| | | |
|---|---|---|
| CN | 2632872 Y | 8/2004 |
| CN | 1862879 | 11/2006 |

(Continued)

OTHER PUBLICATIONS

Daniel W. Aten, and Randy L. Haupt, A. Wideband, Low Profile, Shorted Top Hat Monocone antenna, IEEE Transactions on Antennas and Propagation, vol. 60, No. 10, Oct. 2012,7 pages.

(Continued)

*Primary Examiner* — Daniel J Munoz

(74) *Attorney, Agent, or Firm* — Harness, Dickey & Pierce, P.L.C.; Anthony G. Fussner

(57) ABSTRACT

Disclosed are exemplary embodiments of omnidirectional single-input single-output (SISO) multiband/broadband antennas. In an exemplary embodiment, an omnidirectional SISO multiband/broadband antenna generally includes a radiator element having a single piece construction with a stamped cone shape defined by multiple stamped portions.

17 Claims, 23 Drawing Sheets

(56) References Cited

U.S. PATENT DOCUMENTS

| | | | | |
|---|---|---|---|---|
| 5,506,592 | A | 4/1996 | MacDonald et al. | |
| 7,027,002 | B2 | 4/2006 | Suh et al. | |
| 7,868,818 | B2 | 1/2011 | Henderson | |
| 8,184,060 | B2 | 5/2012 | Du et al. | |
| 8,421,700 | B2 | 4/2013 | Sanford | |
| 8,698,675 | B2 | 4/2014 | Shtrom et al. | |
| 2003/0103008 | A1 | 6/2003 | Petropoulos et al. | |
| 2004/0027304 | A1* | 2/2004 | Chiang | H01Q 1/246 343/810 |
| 2006/0164307 | A1 | 7/2006 | Smith et al. | |
| 2012/0075155 | A1* | 3/2012 | Lindmark | H01Q 1/246 343/797 |
| 2014/0118209 | A1 | 5/2014 | Yona | |
| 2015/0015447 | A1* | 1/2015 | Yona | H01Q 1/48 343/786 |

FOREIGN PATENT DOCUMENTS

| | | | |
|---|---|---|---|
| CN | 2877057 | Y | 3/2007 |
| CN | 201142357 | | 10/2008 |
| CN | 201556703 | | 8/2010 |
| CN | 201859942 | | 6/2011 |
| CN | 203085736 | | 7/2013 |
| CN | 103296485 | | 9/2013 |
| EP | 0376643 | A2 | 7/1990 |

OTHER PUBLICATIONS

Xi Chen1, Guang Gu1 , Li Xil, Simin Zhang2, Super wideband characteristics of monopolar patch antenna, The Journal of Engineering, Nov. 4, 2013, 3 pages.

* cited by examiner

OMNIDIRECTIONAL SINGLE-INPUT SINGLE-OUTPUT MULTIBAND/BROADBAND ANTENNAS

CROSS-REFERENCE TO RELATED APPLICATION

This application claims the benefit of and priority to Malaysian Patent Application No. PI2015702366 filed Jul. 21, 2015. The entire disclosure of the above application is incorporated herein by reference.

FIELD

The present disclosure relates to omnidirectional single-input single-output (SISO) multiband/broadband antennas.

BACKGROUND

This section provides background information related to the present disclosure which is not necessarily prior art.

Omnidirectional antennas may include an inverted cone or shorted inverted cone, which provides very good omnidirectional radiation patterns over a broad bandwidth. But it can be challenging to construct a simple inexpensive structure for an omnidirectional antenna that has good radiation performance over a good bandwidth. In addition, low profile omnidirectional antennas may have Low Passive Intermodulation (PIM) stability problems.

DRAWINGS

The drawings described herein are for illustrative purposes only of selected embodiments and not all possible implementations, and are not intended to limit the scope of the present disclosure.

Figure 6A:
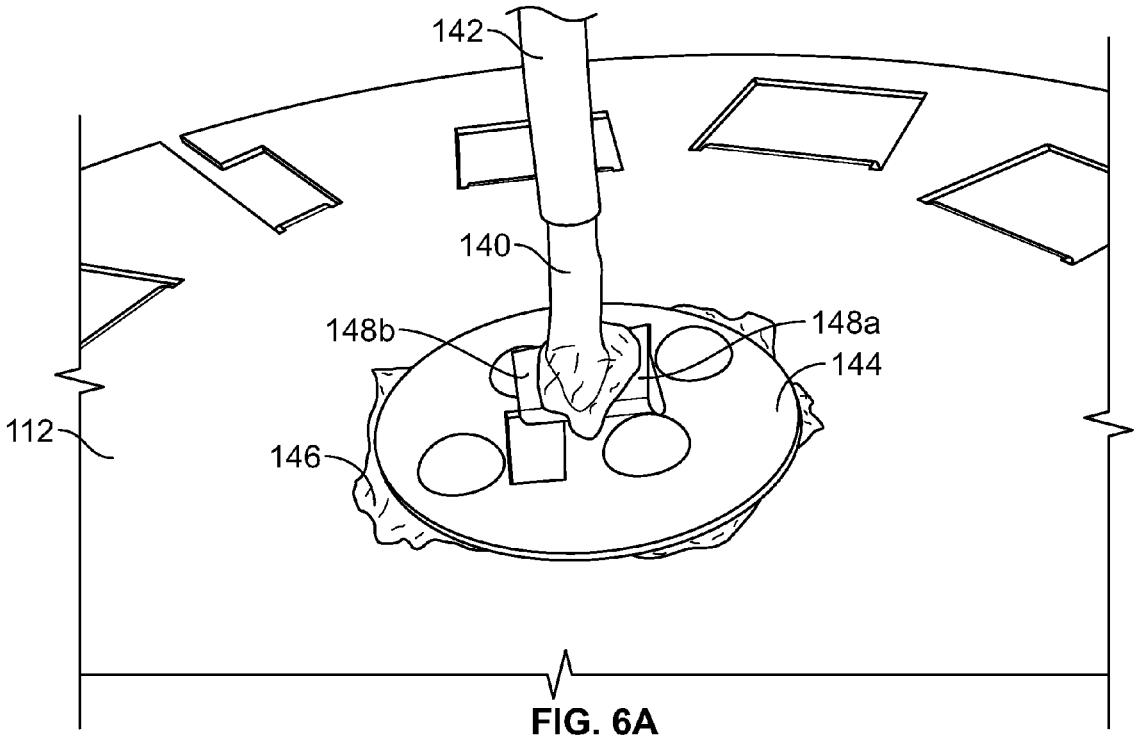
Figure 6B:
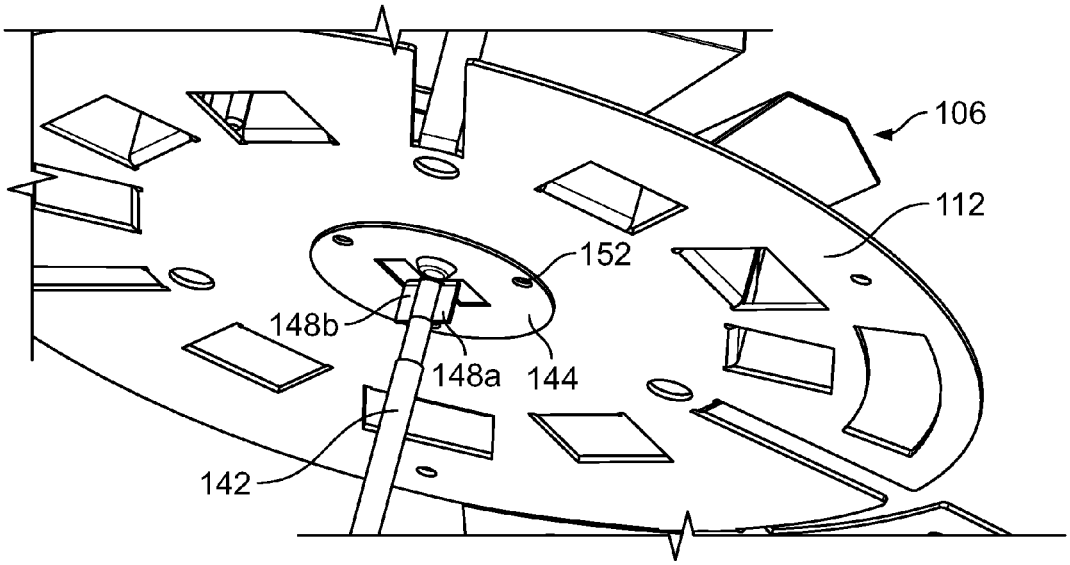
Figure 6C:
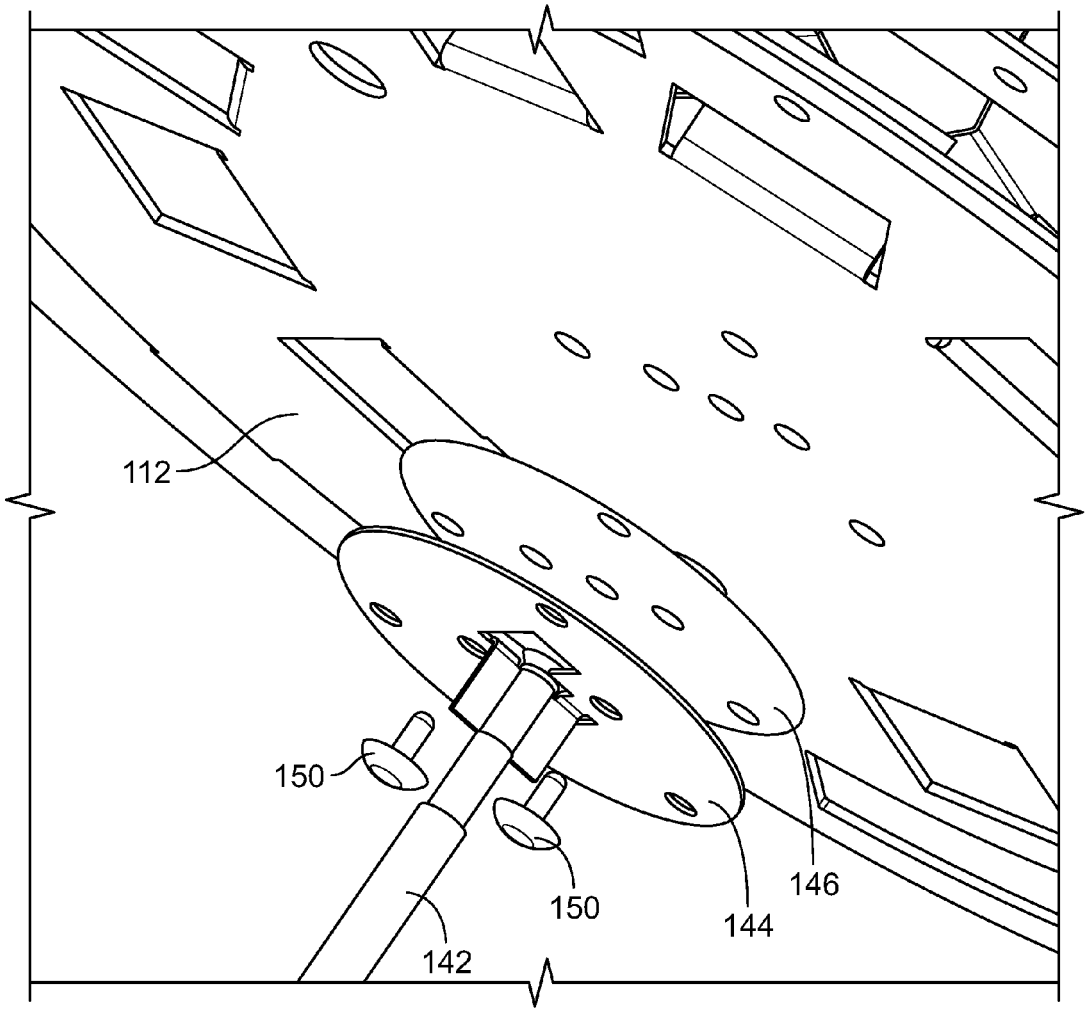
Figure 7A:
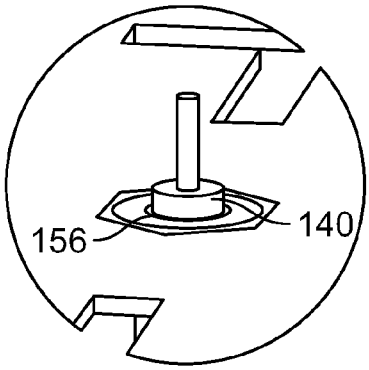
Figure 7B:
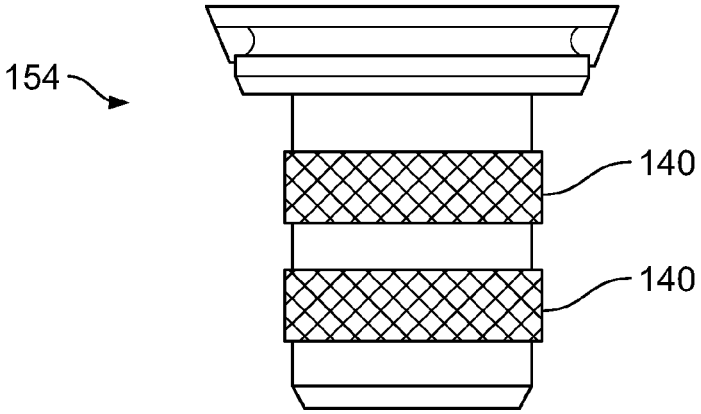
Figure 7C:
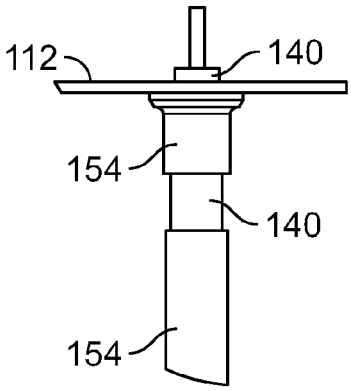
Figure 8:
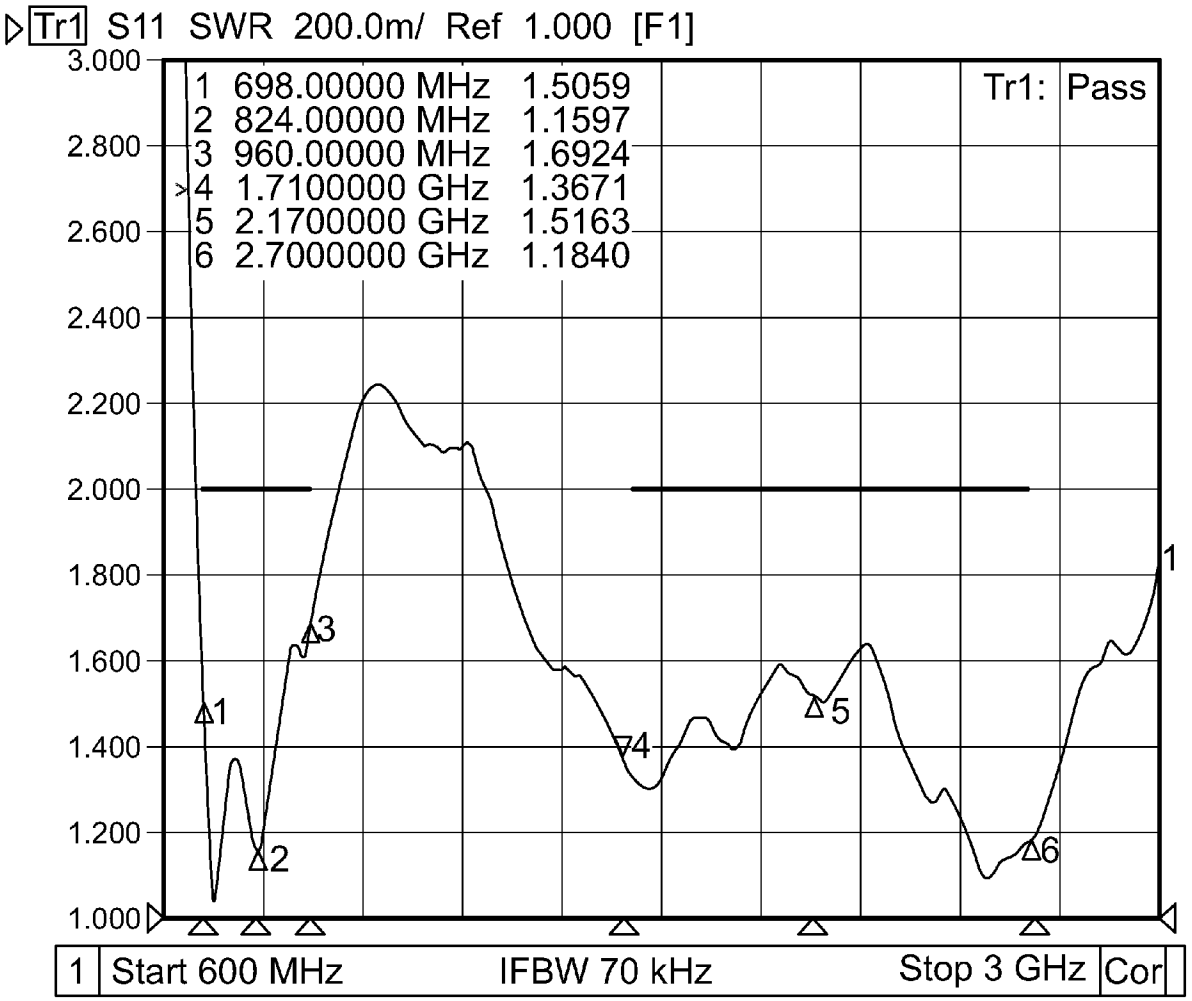
Figure 9:
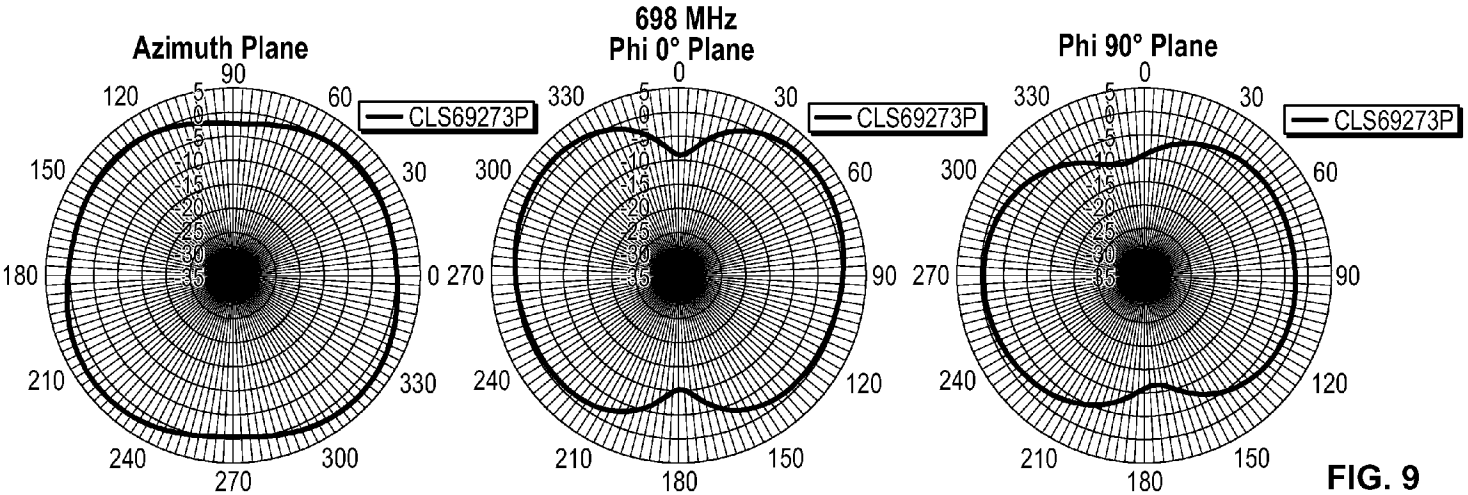
Figure 10:
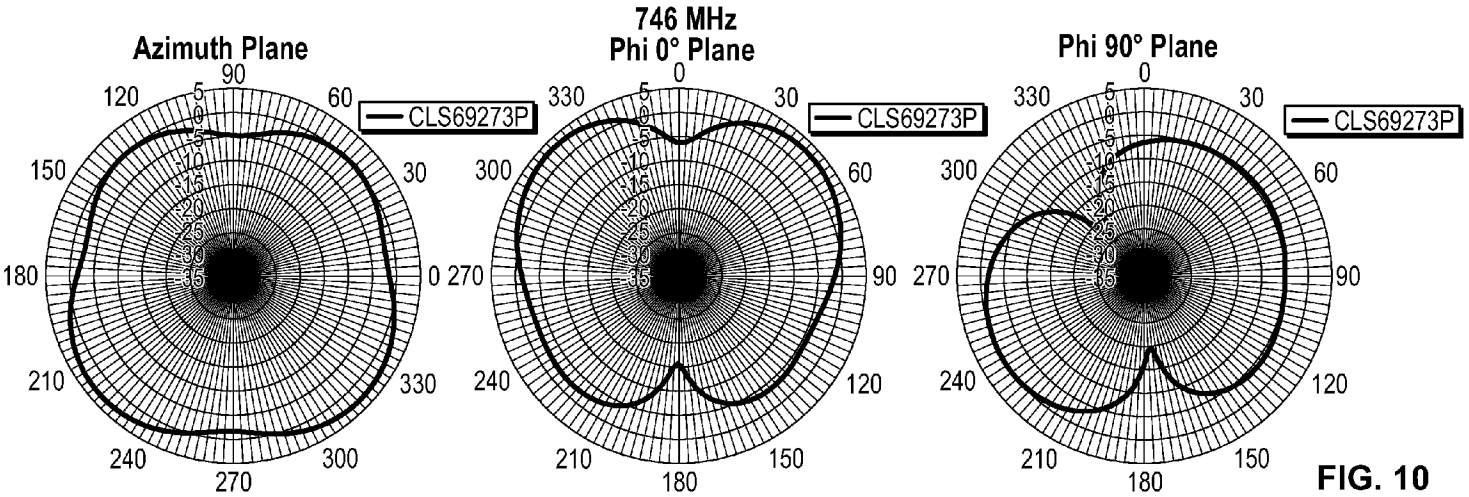
Figure 11:
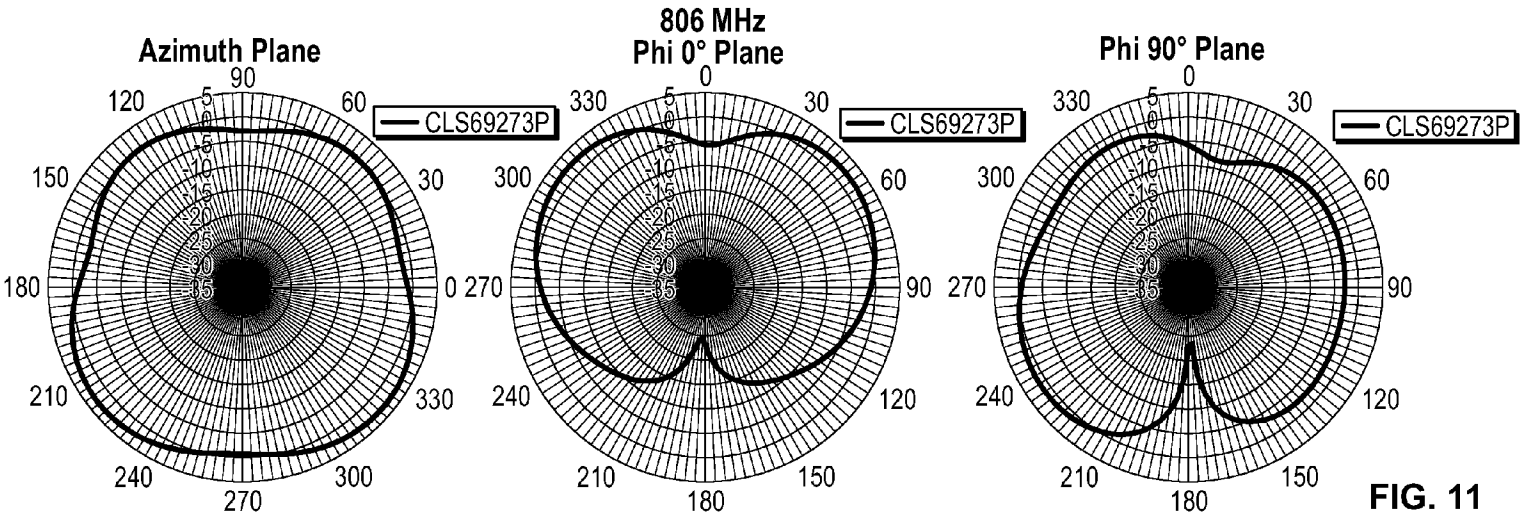
Figure 12:
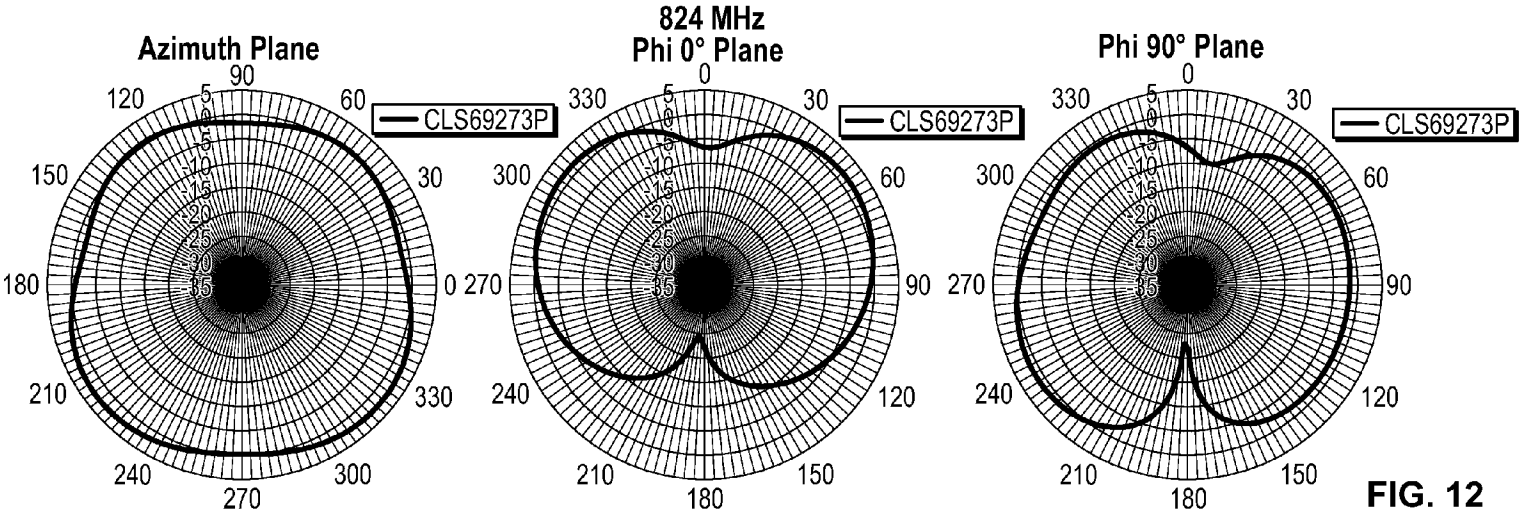
Figure 13:
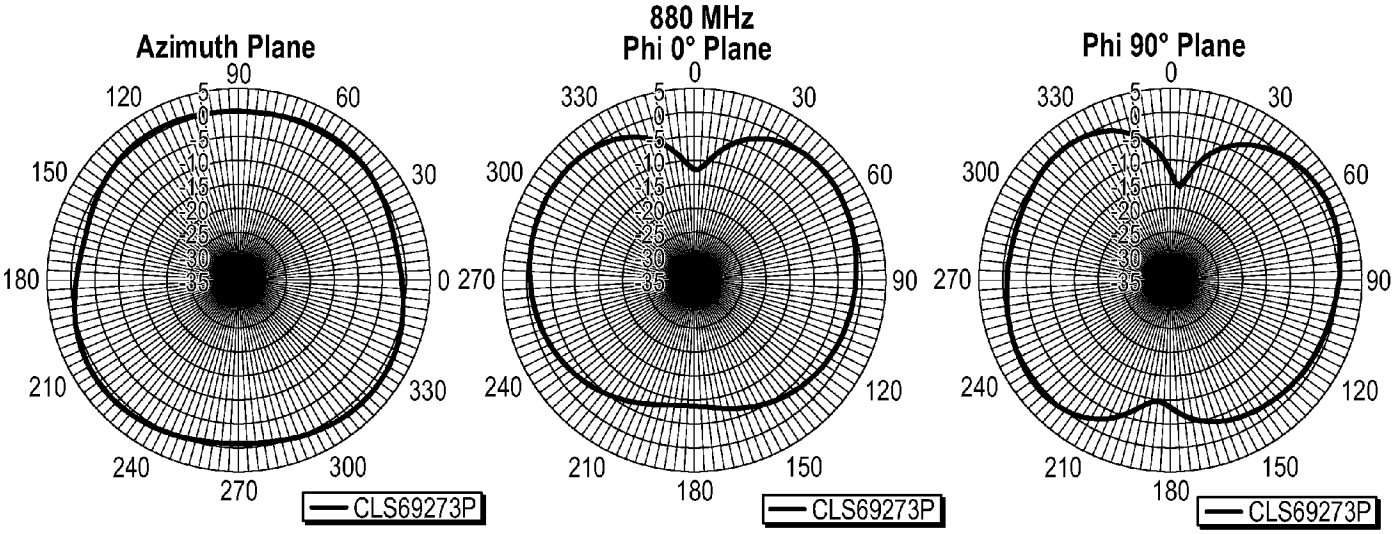
Figure 14:
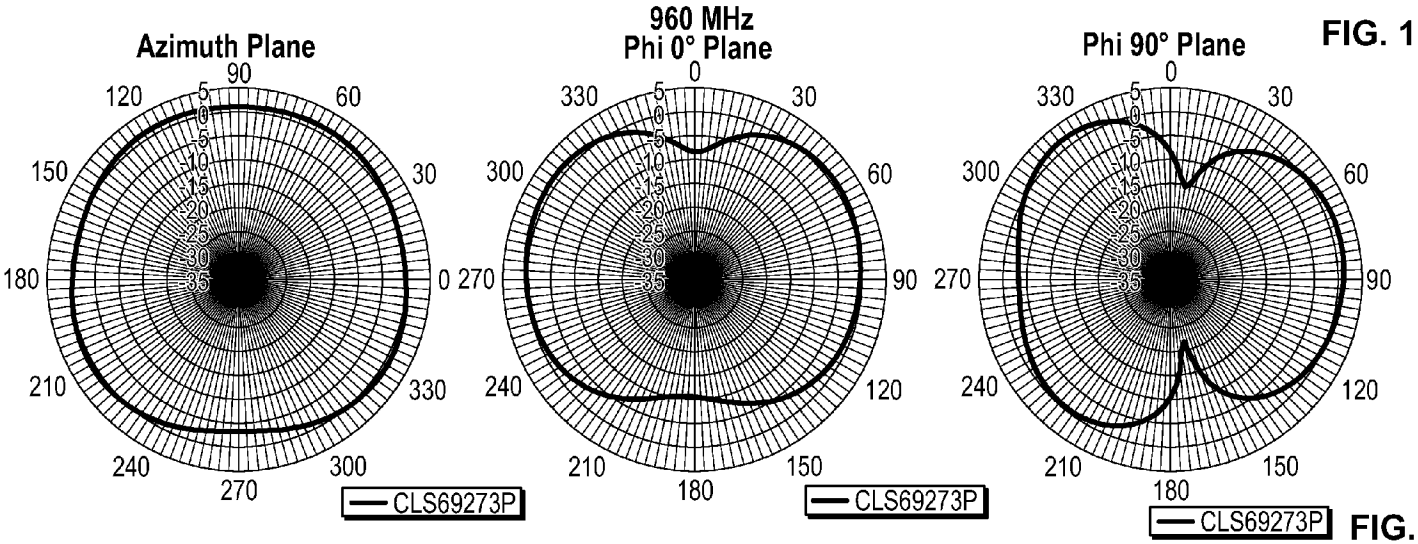
Figure 15:
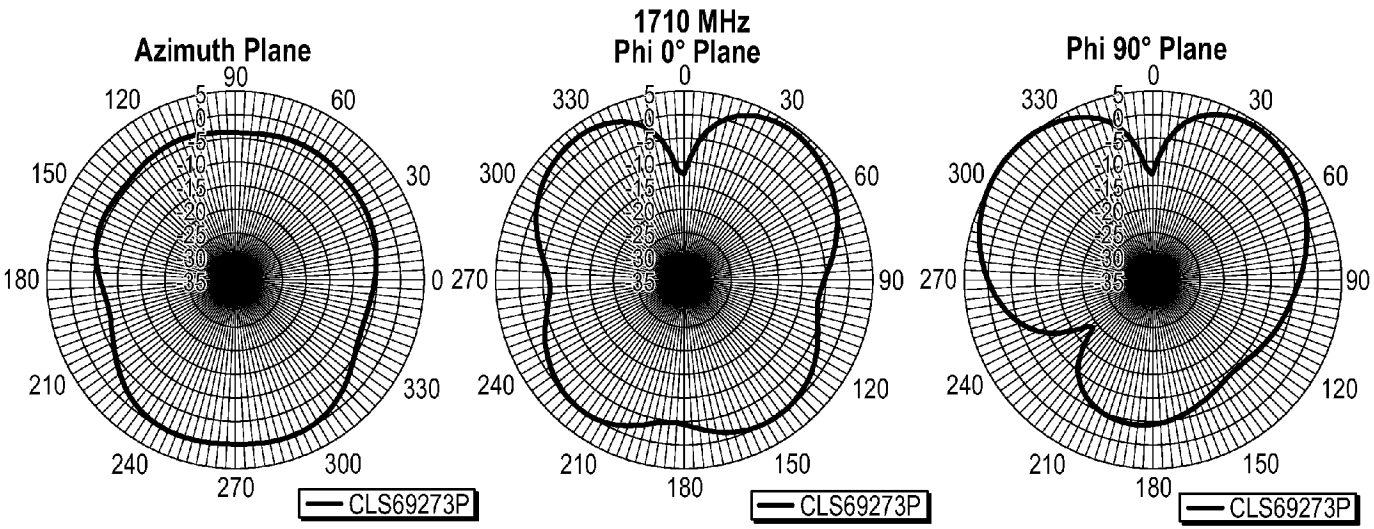
Figure 16:
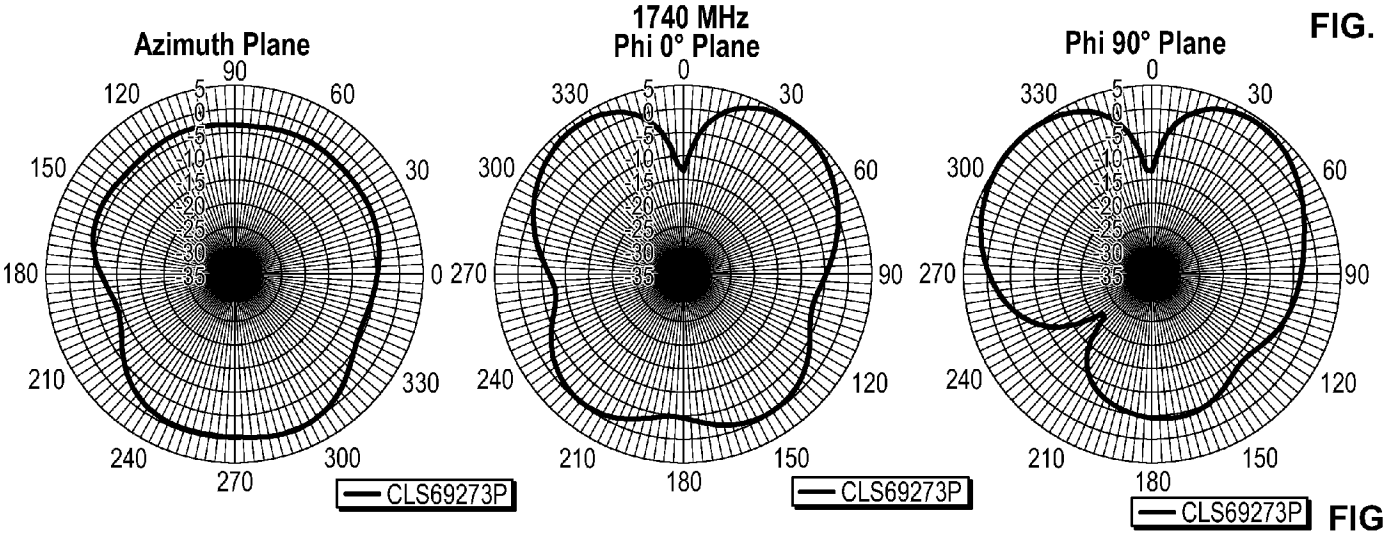
Figure 17:
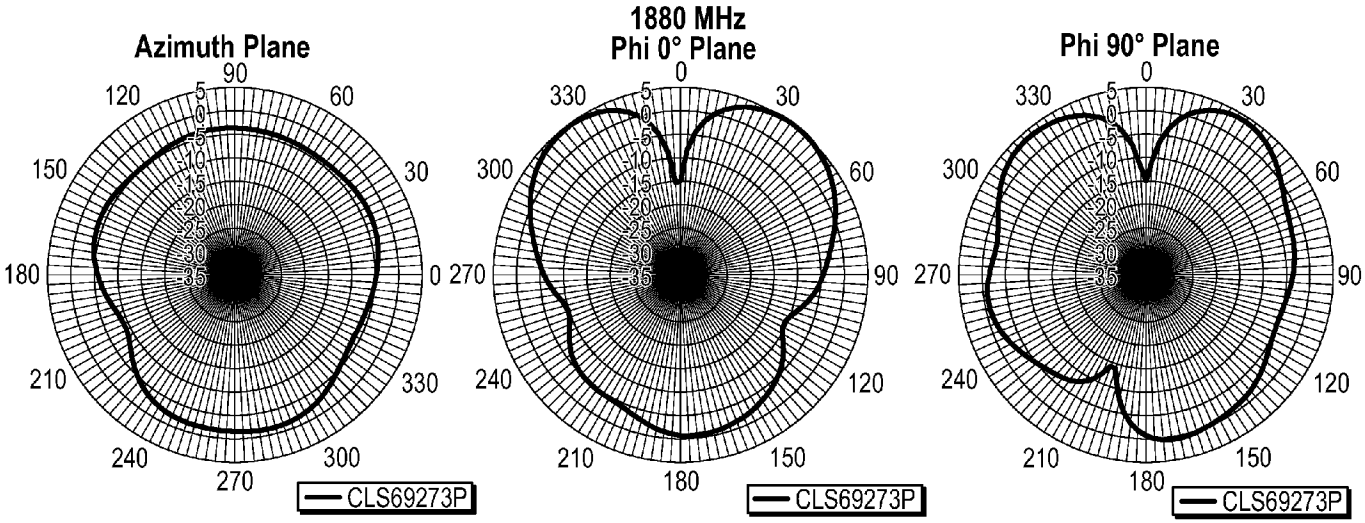
Figure 18:
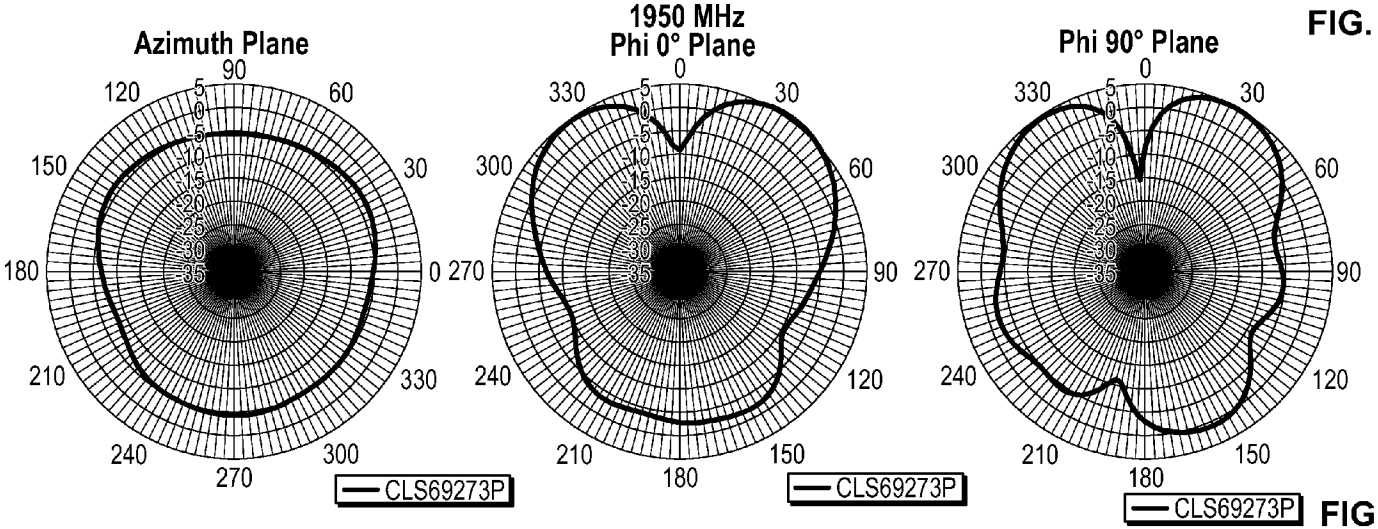
Figure 19:
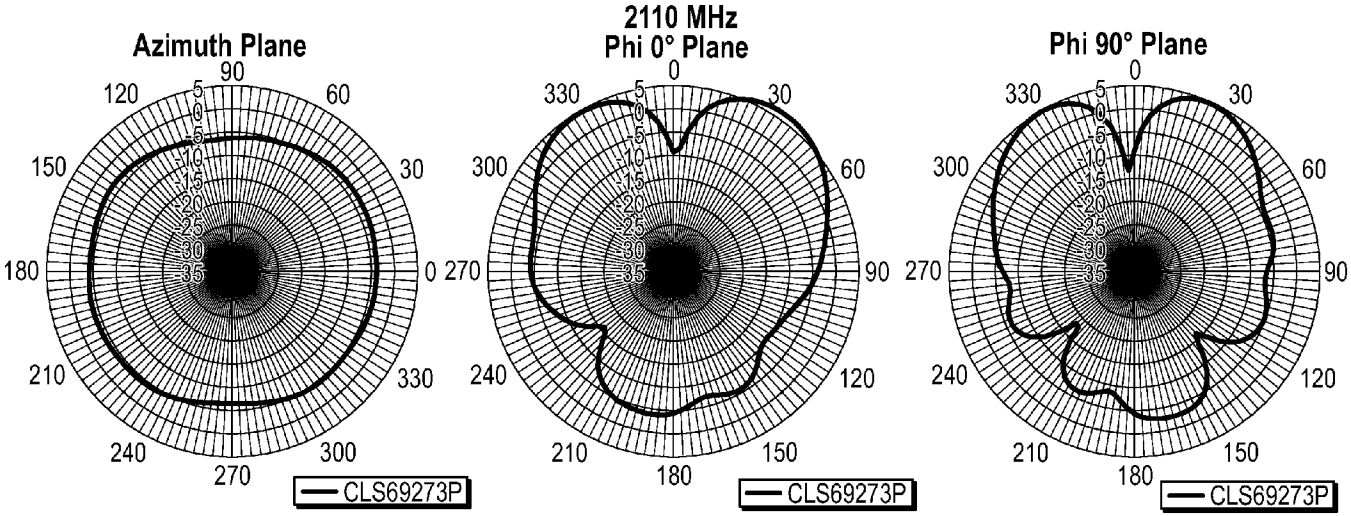
Figure 20:
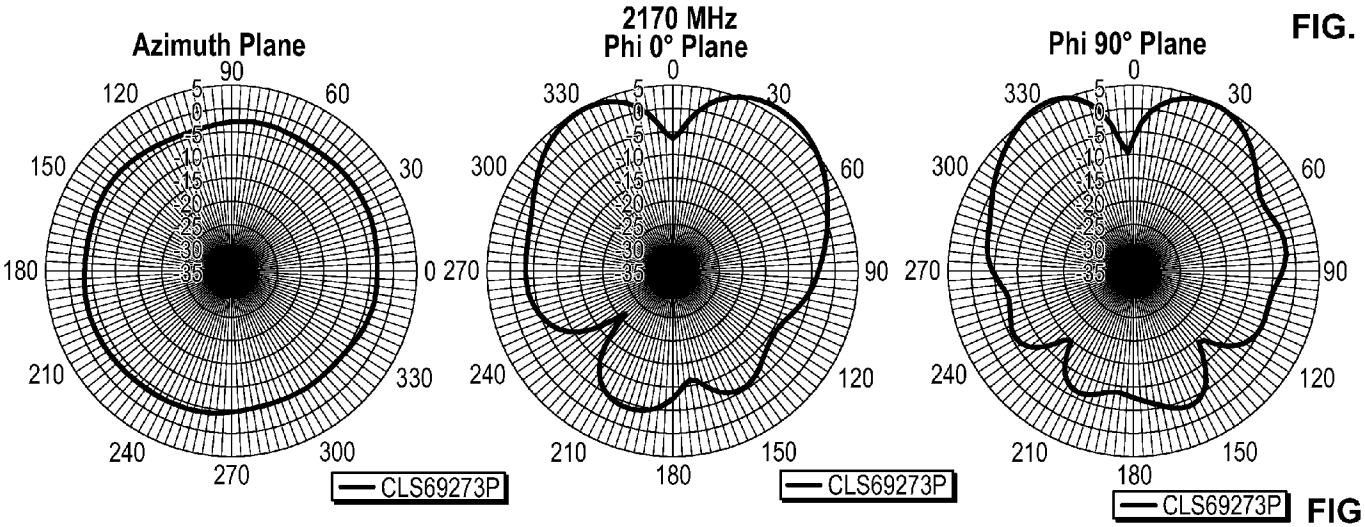
Figure 21:
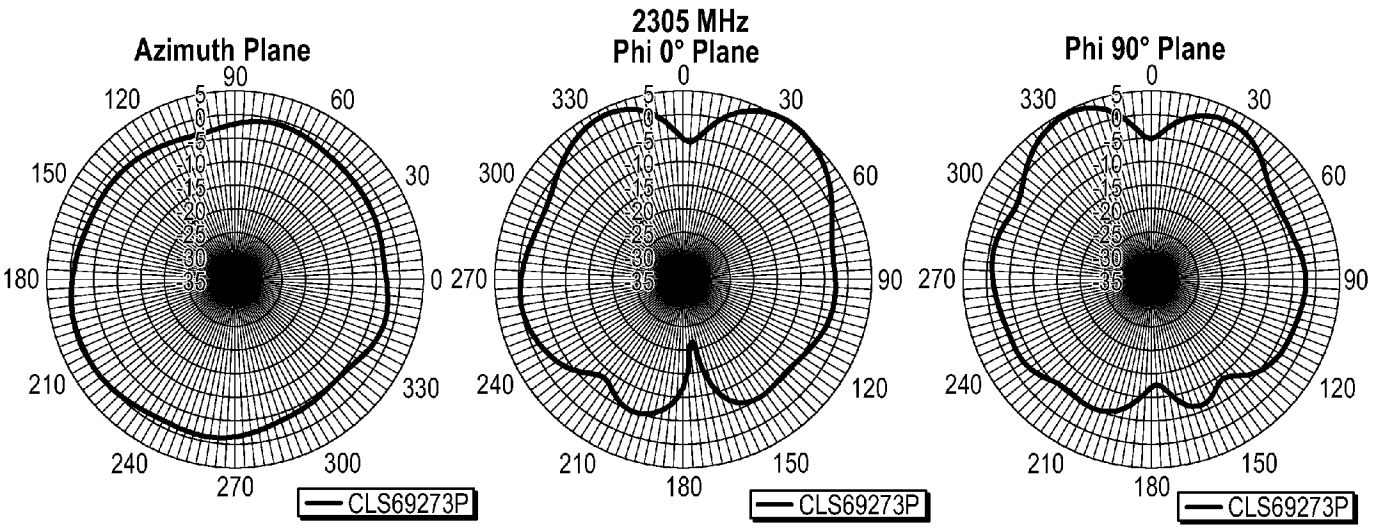
Figure 22:
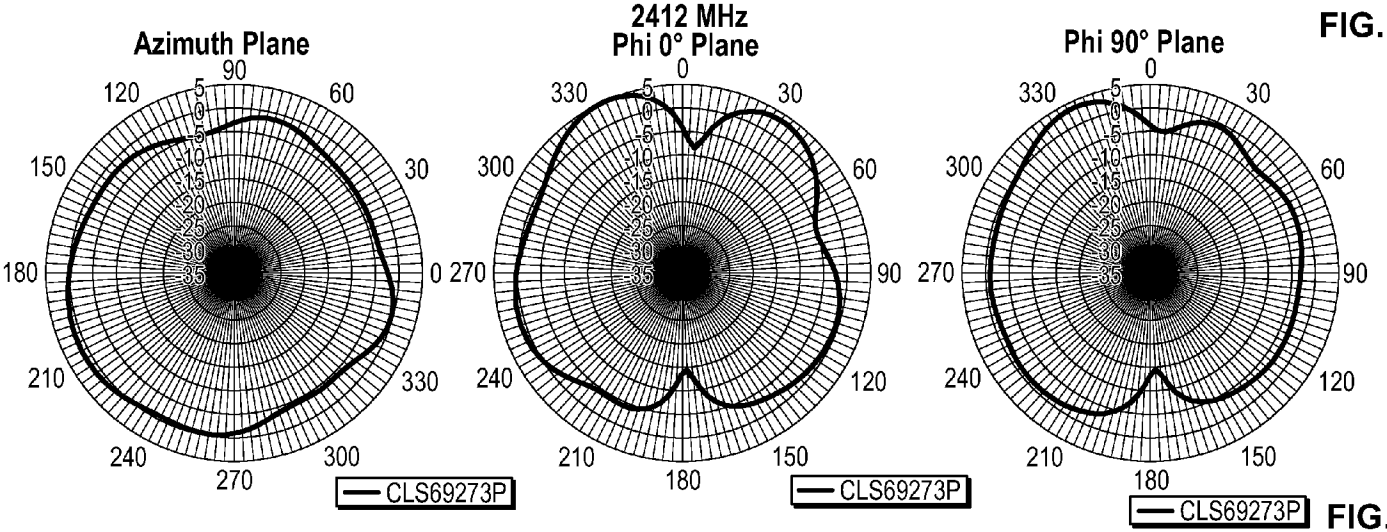
Figure 23:
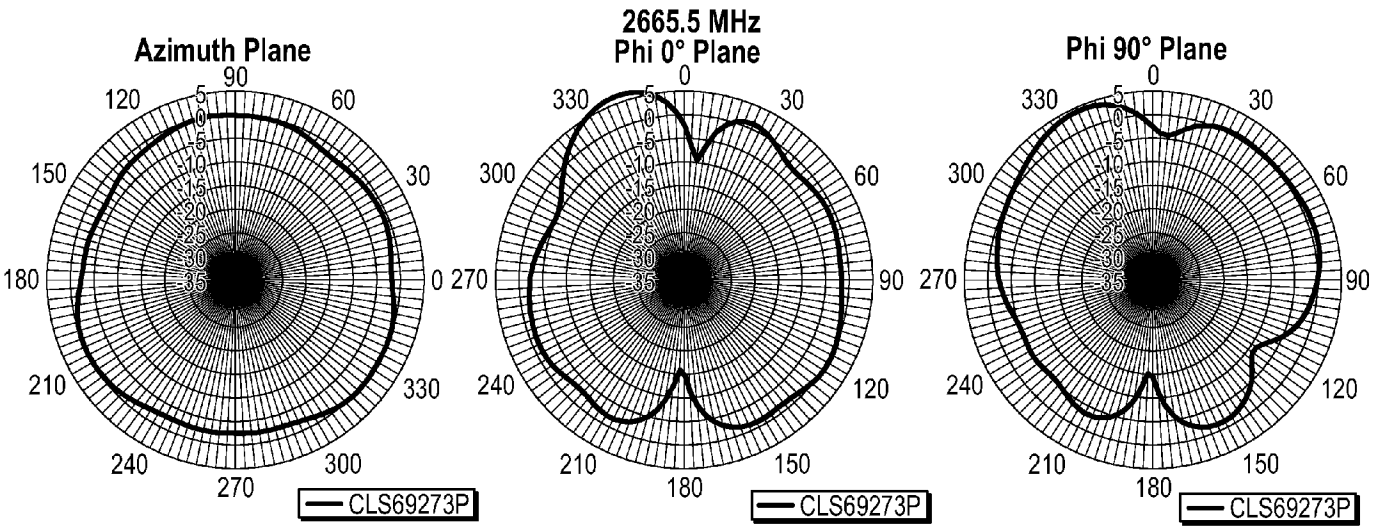
Figure 24:
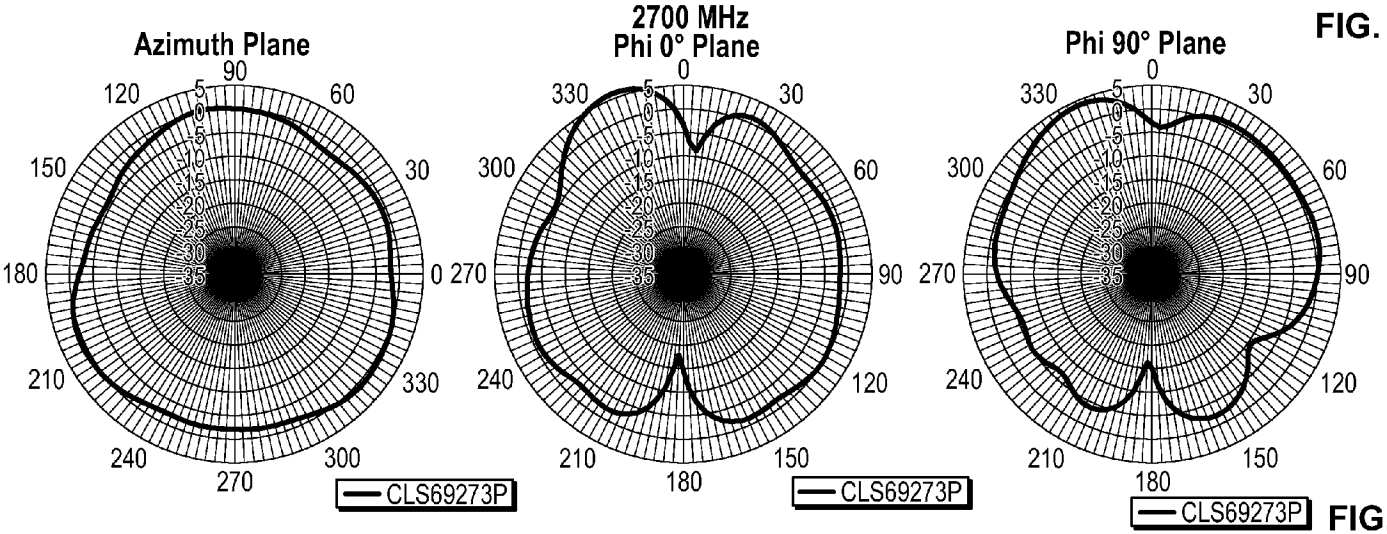
Figure 25:
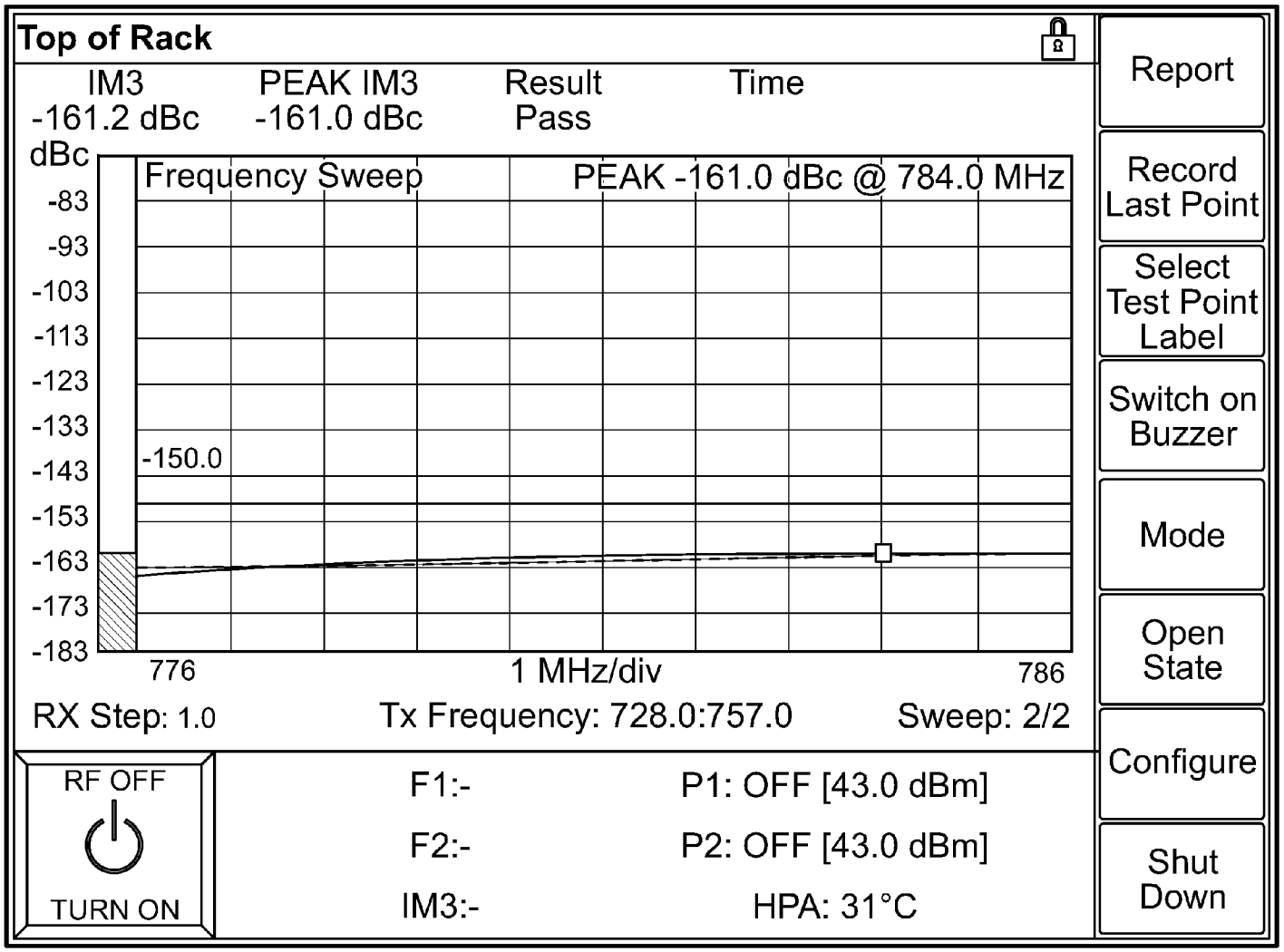
Figure 26:
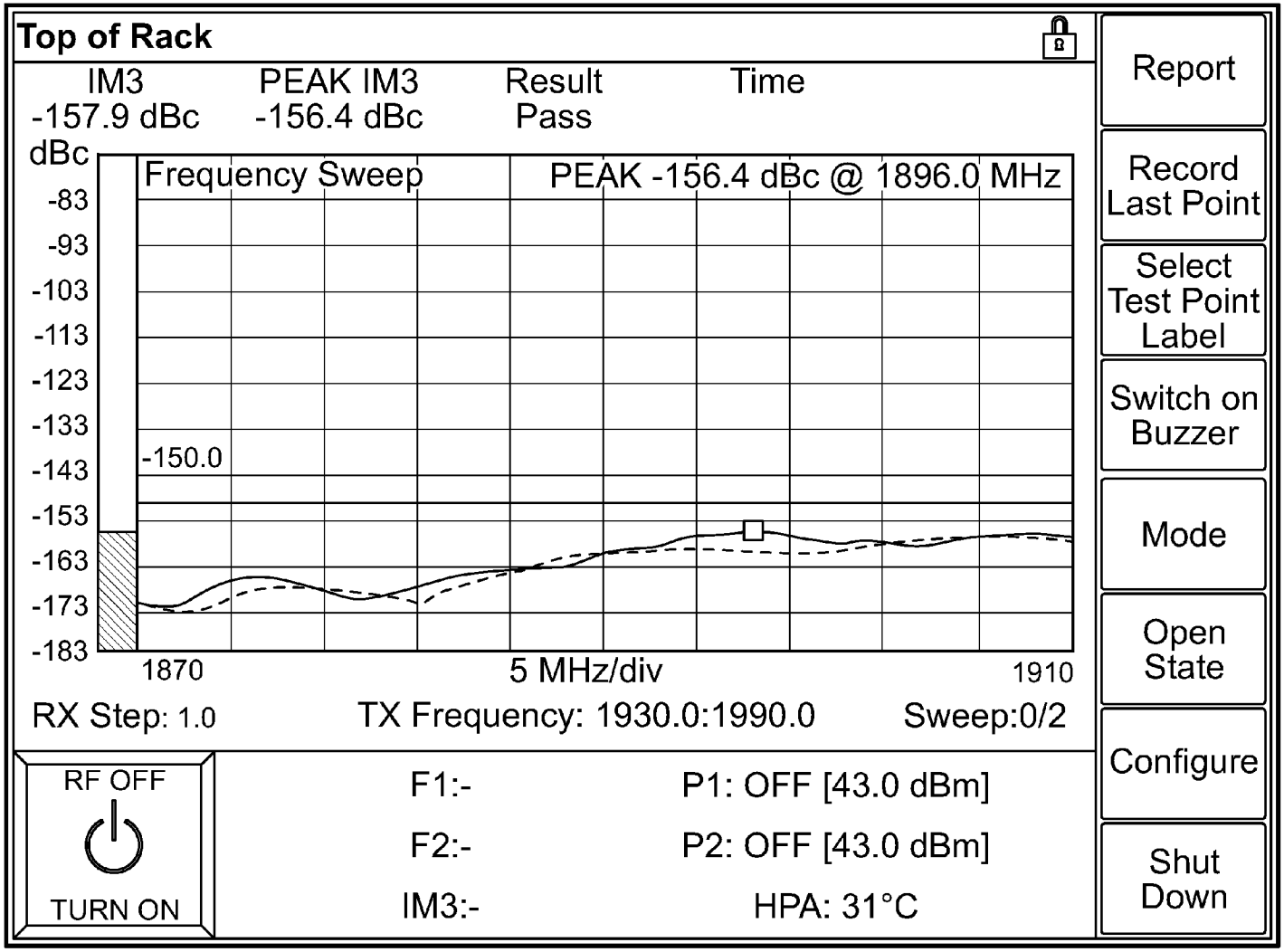

FIGS. 6A through 6C are perspective views showing a coaxial cable and a cable bracket, where a cable braid of the coaxial cable is soldered to the cable bracket and a thin electrical insulator is used to separate and electrically insulate the cable bracket from the antenna ground plane according to exemplary embodiments FIGS. 7A through 7C illustrate a feeding method using a press fit feed through according to exemplary embodiments;

FIG. 8 is an exemplary line graph of voltage standing wave ratio (VSWR) versus frequency measured for a prototype antenna shown in FIGS. 1A through 3 and FIGS. 6A through 6C;

FIGS. 9 through 24 illustrate radiation patterns (azimuth plane, Phi 0° plane, and Phi 90° plane) measured for a prototype antenna shown in FIGS. 1A to 3 and FIGS. 6A through 6C at frequencies of 698 megahertz (MHz), 746 MHz, 806 MHz, 824 MHz, 880 MHz, 960 MHz, 1710 MHz, 1740 MHz, 1880 MHz, 1950 MHz, 2110 MHz, 2170 MHz, 2305 MHz, 2412 MHz, 2665.5 MHz, and 2700 MHz, respectively; and FIGS. 25 and 26 are exemplary line graphs of intermodulation level (IM) in decibels relative to carrier (dBc) versus frequency in megahertz (MHz) showing PIM (IM3) performance for two transmitted carriers (20 W each) measured for a prototype antenna shown in FIGS. 1A to 3 and FIGS. 6A through 6C at respective frequencies of 728 MHz to 757 MHz and 1930 MHz to 1990 MHz.

Corresponding reference numerals indicate corresponding parts throughout the several views of the drawings.

DETAILED DESCRIPTION

Example embodiments will now be described more fully with reference to the accompanying drawings.

The inventors hereof have recognized a need for a multiband/broadband SISO omnidirectional antenna that has a simple inexpensive low profile structure by using a single sheet of metal with stamped parts and that has sufficient mechanical self-support by providing multiple shorting legs extended from a ground element for electrically coupling to and mechanically supporting the multiple stamped parts. The inventors hereof have further recognized a need for multiband/broadband SISO omnidirectional antennas that have relatively stable low PIM (Passive Intermodulation) (e.g., able to qualify as a low PIM rated design, etc.) by utilizing a bracket (e.g., a cable bracket, etc.), that have good or improved bandwidth (e.g., from 698 MHz to 2700 MHz, etc.), and/or that provide more VSWR margins at production. Accordingly, the inventors' developed and disclose exemplary embodiments of omnidirectional SISO multiband/broadband antennas that include radiator elements constructed by simple processes for broadband omnidirectional SISO antennas (e.g., 100 (FIG. 2), etc.) including parts stamped from a single sheet of metal and a low PIM rated design.

Exemplary embodiments include a radiator or antenna element having a simple inexpensive low profile structure. The radiator element has a single piece construction with a stamped cone shape defined by multiple stamped portions. The stamped cone shape and multiple stamped portions may be configured to improve omnidirectionality of the radiation patterns of the antenna. In exemplary embodiments, each of the multiple stamped portions may include one or more steps or other non-linear configuration for electrically lengthening the radiator element and gradually changing impedance to broaden bandwidth.

Additionally, exemplary embodiments may further include one or more (or all) of the following features to realize or achieve low PIM level. In exemplary embodiments, the antenna preferably has an improved or low PIM level with either the galvanic contact soldered or proximity coupling and not with very high compression contact if the high compression is not achievable by the size of the components for the assemblies. Further, the ground plane may include a cable bracket designed for soldering a cable assembly to provide stable low PIM performance, especially for the lower frequency band for which it tends to be more difficult to achieve a reasonable PIM level.

Figure 1B:
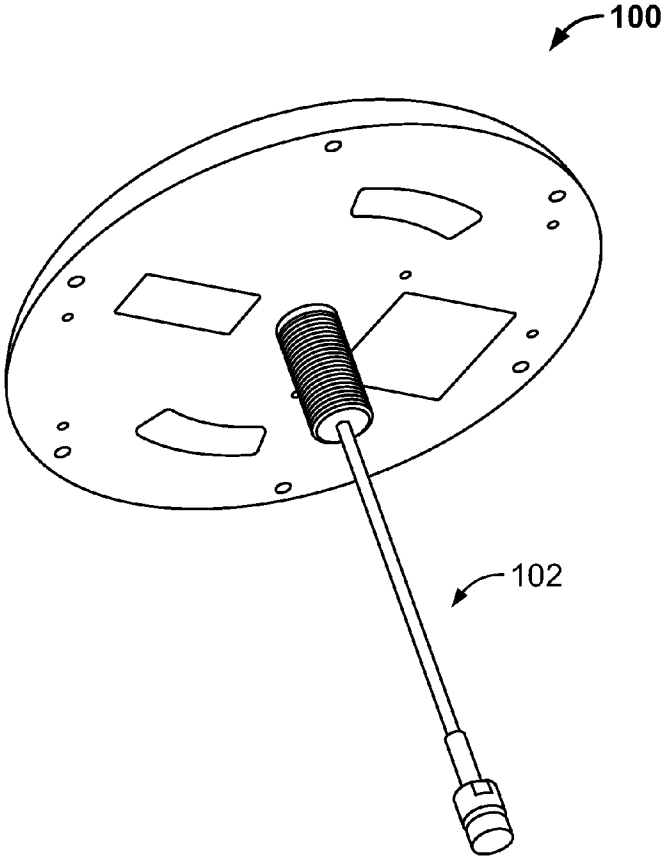
FIGS. 1A and 1B are perspective views of an exemplary embodiment of an omnidirectional SISO antenna assembled with a fixture that may be installed to a ceiling.
Figure 1A:
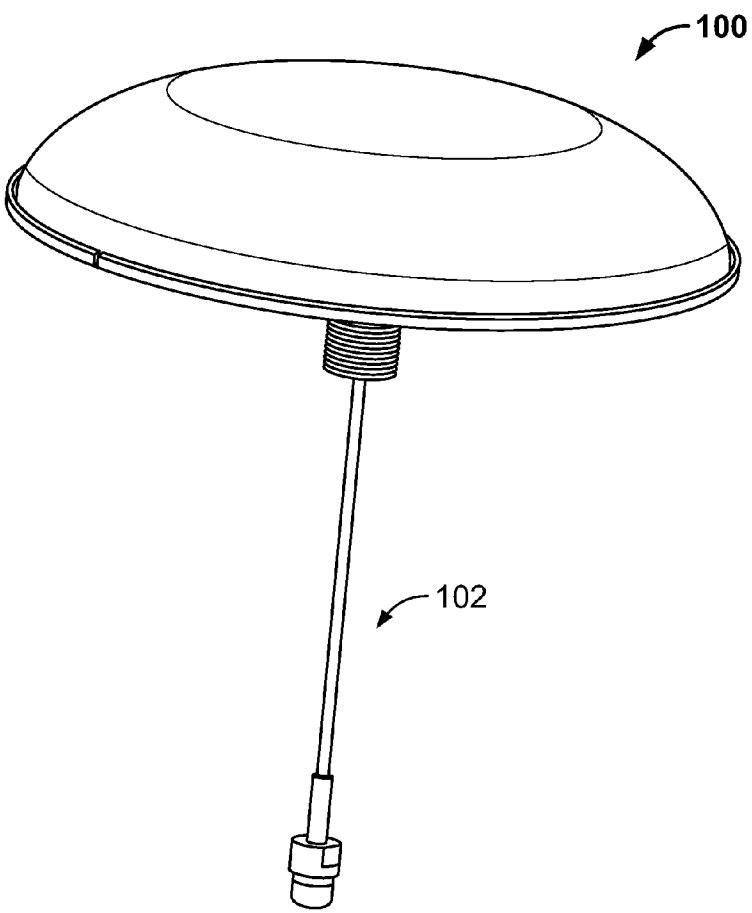

With reference now to the figures, FIGS. 1A and 1B illustrate an exemplary embodiment of an omnidirectional SISO antenna 100 embodying one or more aspects of the present disclosure. As shown, the antenna 100 includes a low profile design (e.g., a design having an exponential tapered cone shape or form with a small height, etc.). The antenna 100 may be a compact, ultra-broadband, in-building antenna, and may be used for applications such as a distributed antenna system. For example, the antenna 100 may be assembled with a fixture 102 to be mounted to a ceiling in some embodiments with an aesthetically pleasing look (e.g., looks like an umbrella installed on the ceiling, etc.). The antenna 100 may be vertically polarized, and may operate at a frequency range between about 698 MHz to about 2700 MHz. The antenna 100 may support public safety frequency (TETRA).

Figure 2:
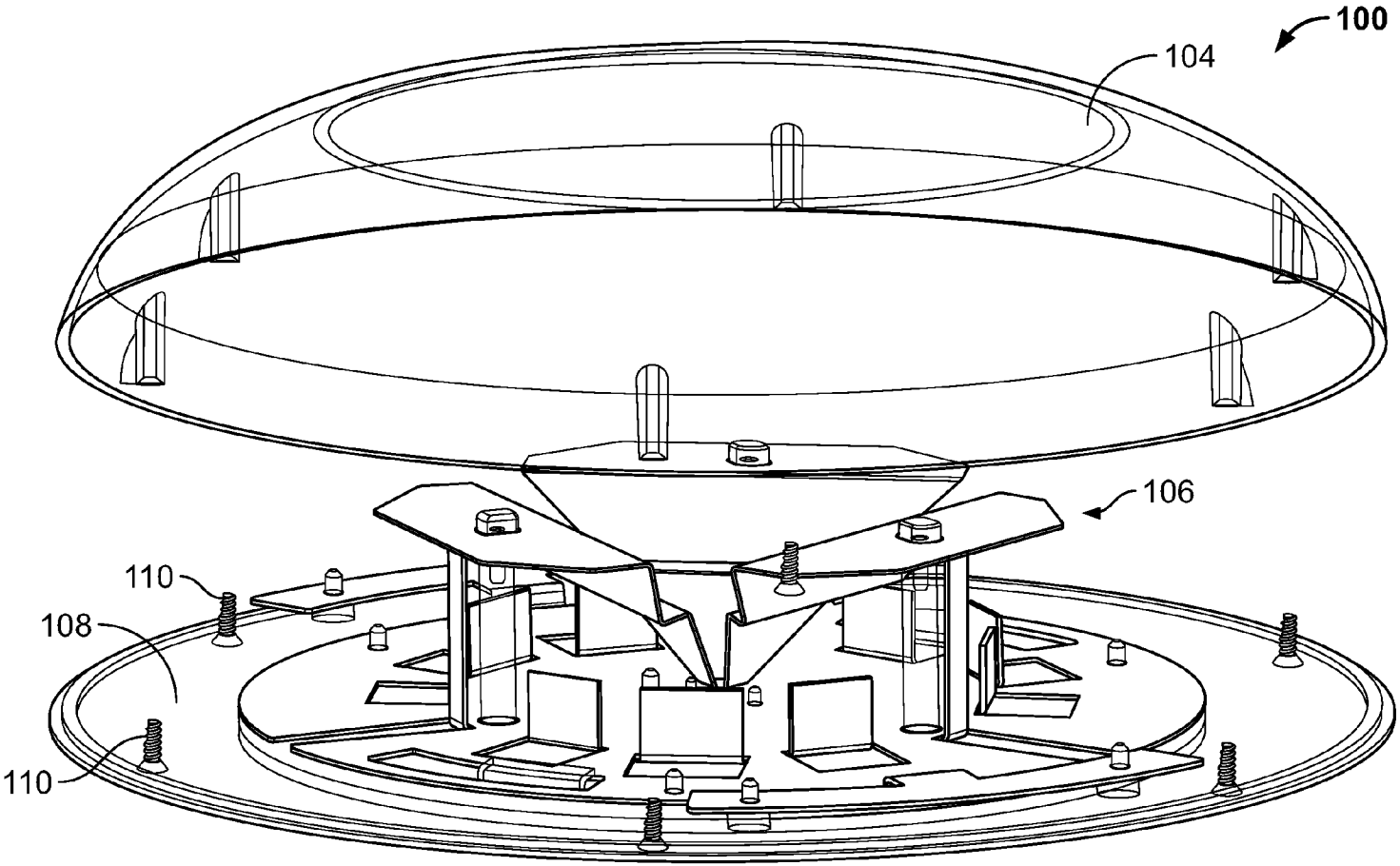
FIG. 2 is a perspective view of the omnidirectional SISO antenna shown in FIGS. 1A and 1B where the cover or radome has been opened from the base.

As shown in FIG. 2, the antenna 100 may also include a radome or cover 104 (e.g., a plastic radome, etc.). The cover 104 is configured to protect the relatively fragile radiator element 106 from damage due to environmental conditions such as vibration or shock during use. The cover 104 may be formed from a wide range of materials, such as, for example, polymers, urethanes, plastic materials (e.g., polycarbonate blends, Polycarbonate-Acrylnitril-Butadien-Styrol-Copolymer (PC/ABS) blend, etc.), glass-reinforced plastic materials, synthetic resin materials, thermoplastic materials (e.g., GE Plastics Geloy® XP4034 Resin, etc.), etc. within the scope of the present disclosure.

Further, the radiator element 106 is within the interior enclosure cooperatively defined by the cover or radome 104 and a base assembly or chassis 108 (e.g., dielectric base, plastic base, etc.). The end cap portion of the radome 104 has a diameter substantially similar to the diameter of the base assembly 108. The radome 104 can be secured with the base assembly 108 using any fasteners or connectors 110 (e.g., bolt and nuts, plastic rivets, heat staking, etc.).

Figure 3:
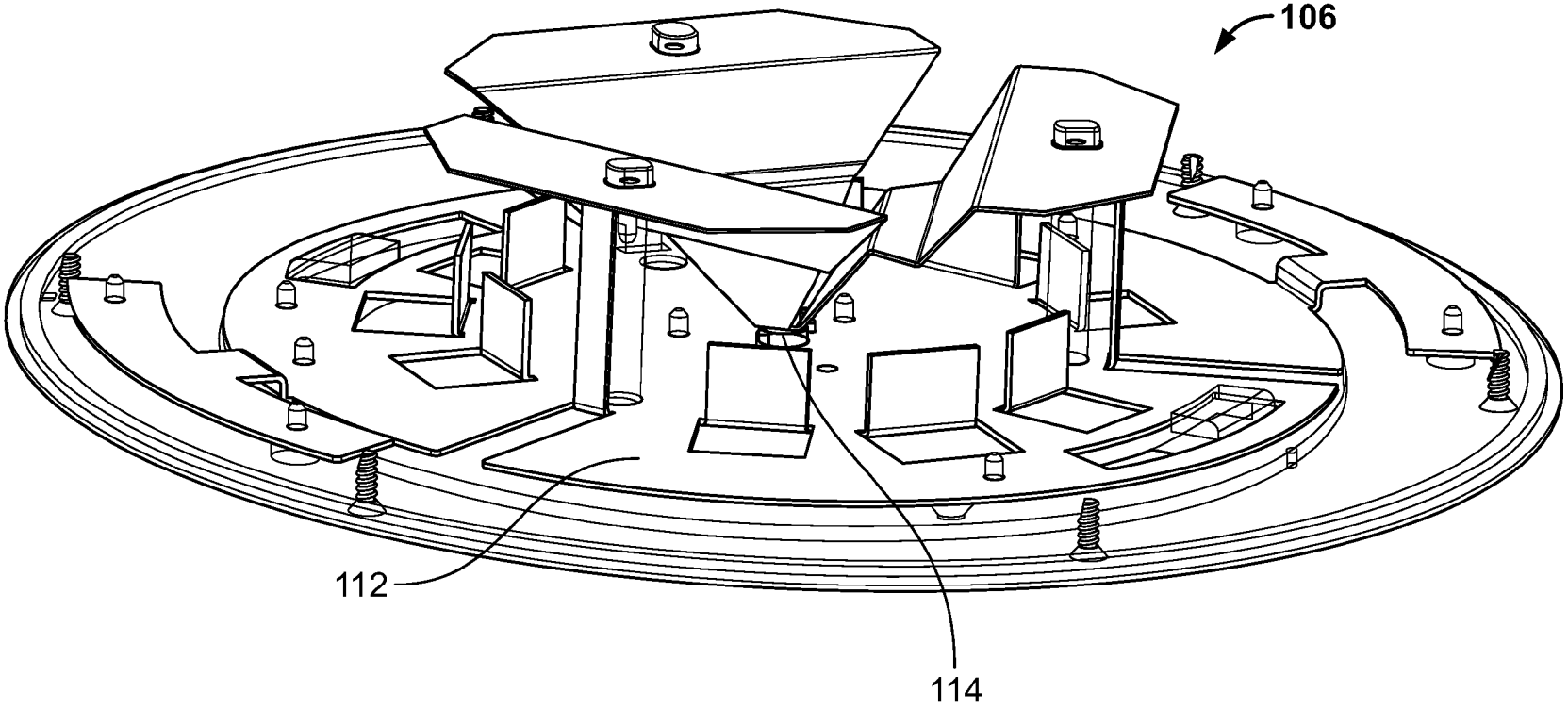
FIG. 3 is a perspective view of the omnidirectional SISO antenna shown in FIGS. 1A through 2 where the cover or radome has been removed from the base.

FIG. 3 shows the antenna with the cover or radome 104 removed from the base 108. The radiator element 106 includes a cup or cone shape defined by several stamped portions (e.g., brass, aluminum, other metal, etc.) that are separated from each by a gap or spaced distanced therebetween. Additionally, a ground plate 112 is illustrated as a flat, circular plate located perpendicular to a center axis of the radiator element 106. Alternative embodiments may include other suitable ground members or ground planes besides the ground plate 112, such as a ground member having a non-circular shape (e.g., rectangular, octagonal, hexagonal, triangular, etc.) and/or that is not flat or plate like, etc.

Conventionally, omnidirectional SISO antennas may include inverted cones or shorted inverted cones to enable a broadband characteristic of the antennas. But conventional cone-shaped radiators require a complicated and expensive process to construct the cone-shaped radiator. Alternatively, omnidirectional SISO antennas may combine several monopole radiators together. In these cases, each monopole radiator may have simple construction, but additional processes are needed to join monopole radiator parts together. Further, radiators with simple construction stamping parts may not be able to provide the similar performance of the inverted shorted cone antenna. Monopole radiators are also not self-supporting structures such that other extra mechanical structures are needed to hold the radiator in place. After recognizing the above, the inventors hereof developed and disclose herein exemplary embodiments of radiator elements having a simple construction with good performance.

FIGS. 4A to 4D show the radiator element 106, which has a shape similar to an inverted conical, exponentially tapered form. The radiator element 106 is constructed as an integrally formed single sheet of metal defined by stamped parts or portions 116. The radiator element 106 is based on a monopole antenna made of brass, aluminum, or other metal or electrically-conductive material. After the single sheet of metal is stamped into multiple petals (broadly, portions), the multiple petals 116 are formed or configured (e.g., bent, curved, etc.) to form the cup-shaped or cone-shaped radiator depending on the required operating frequency ranges and required radiator height, etc.

Each stamped portion or petal 116 of the illustrated antenna radiator 106 may include an outwardly extending, tapering, stepped, curved, convex, or non-linear side. The multiple petals 116*a*, 116*b*, 116*c* are integrally joined at the center 114 to form a central symmetrical structure similar to a tapered cone shape to improve bandwidth of the antenna 100. The stamped multiple petals 116*a*, 116*b*, 116*c* remain connected to the center 114 and thus to each other during and after the stamping process. Accordingly, the stamped multiple petals 116*a*, 116*b*, 116*c* are not separate stamped pieces that must be welded or joined together. Although one example single sheet of metal with stamped parts or petals 116 is illustrated in FIGS. 4A to 4D, other embodiments may include an antenna radiator element having other forms or shapes (e.g., other exponential tapered shapes or conical forms with stamped portions, cones approaching the exponential taper with stamped portions, regular cone shaped with stamped sheets, etc.). The chamfer parameters of the tapered form (e.g., distances and/or angles of edges, faces, and/or vertex, etc.) depend on the electrical length and/or profile required by the radiators. Also, the example radiator element 106 includes three petals 116*a*, 116*b*, 116*c*. But alternative embodiments may include more or less than three petals.

The center 114 of the radiator element 106 may also function as a feeding point. For example, a center conductor or core of a coaxial cable may be electrically connected, (e.g., soldered, etc.) to the center 114 for feeding the radiator element 106. The gradual change of impedance due to the tapering of the petals 116 from the feeding point or center 114 enables a broader bandwidth.

In this exemplary embodiment, the center axis of the antenna radiator 106 with a symmetrical structure is aligned with the center of the ground plate 112 to have conventional dipole-like omnidirectional radiation patterns.

Figure 4A:
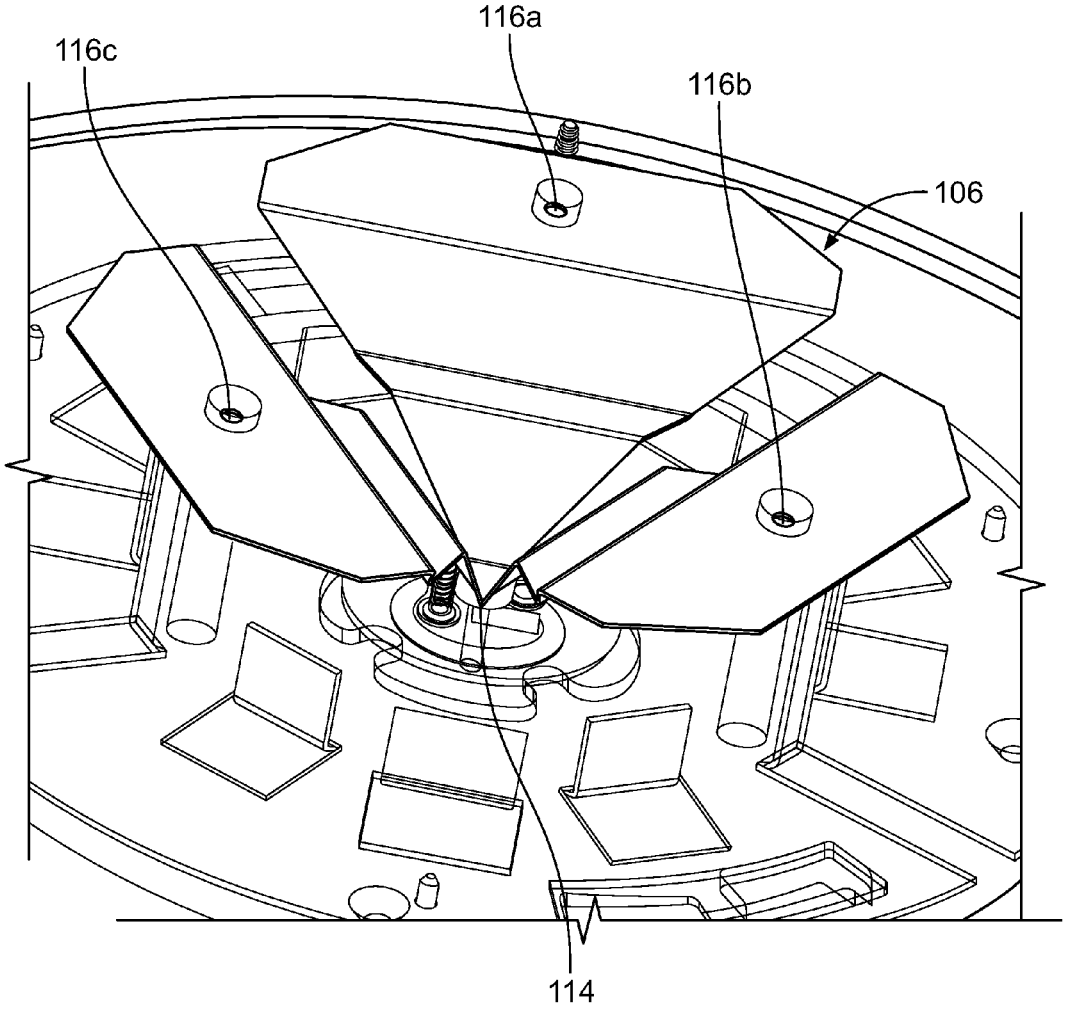
FIGS. 4A through 4D are different views of the radiator element of the omnidirectional SISO antenna shown in FIGS. 1A through 3.
Figure 4B:
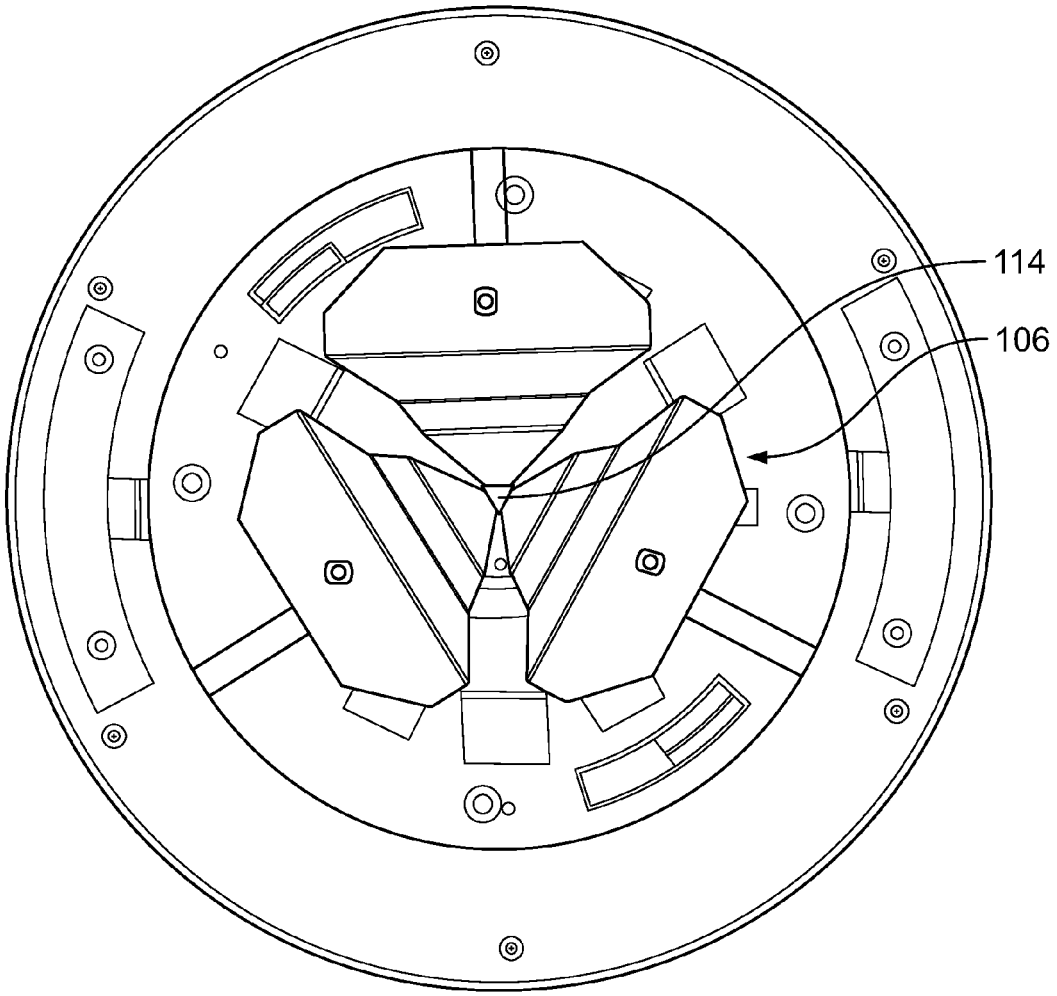
Figure 4C:
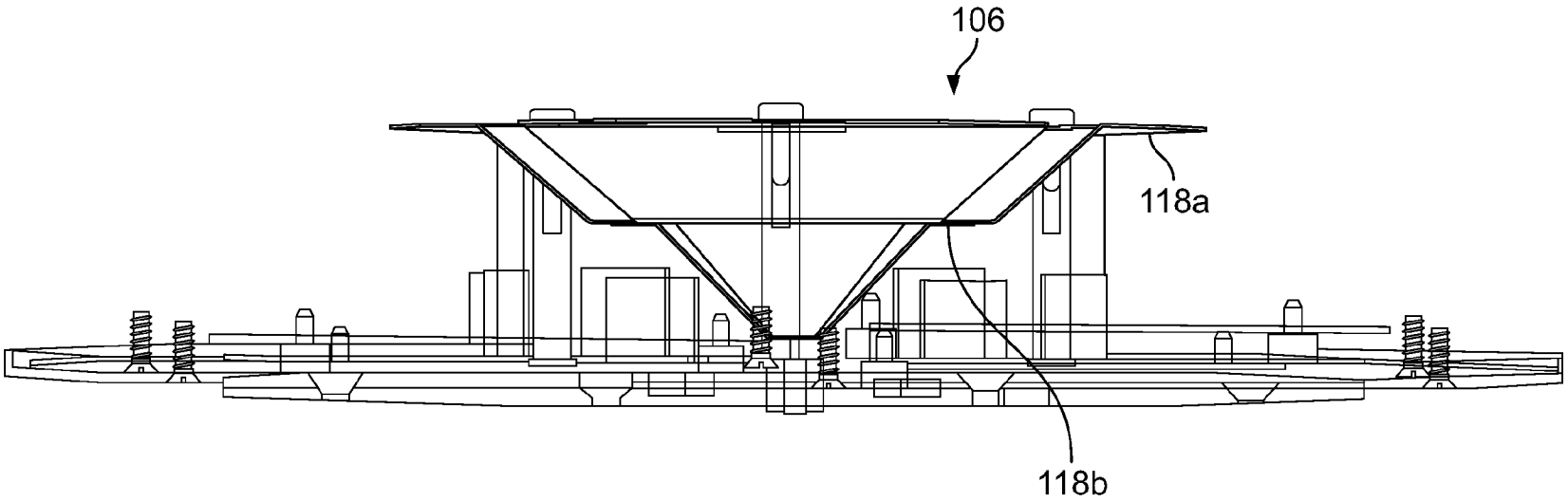
Figure 4D:
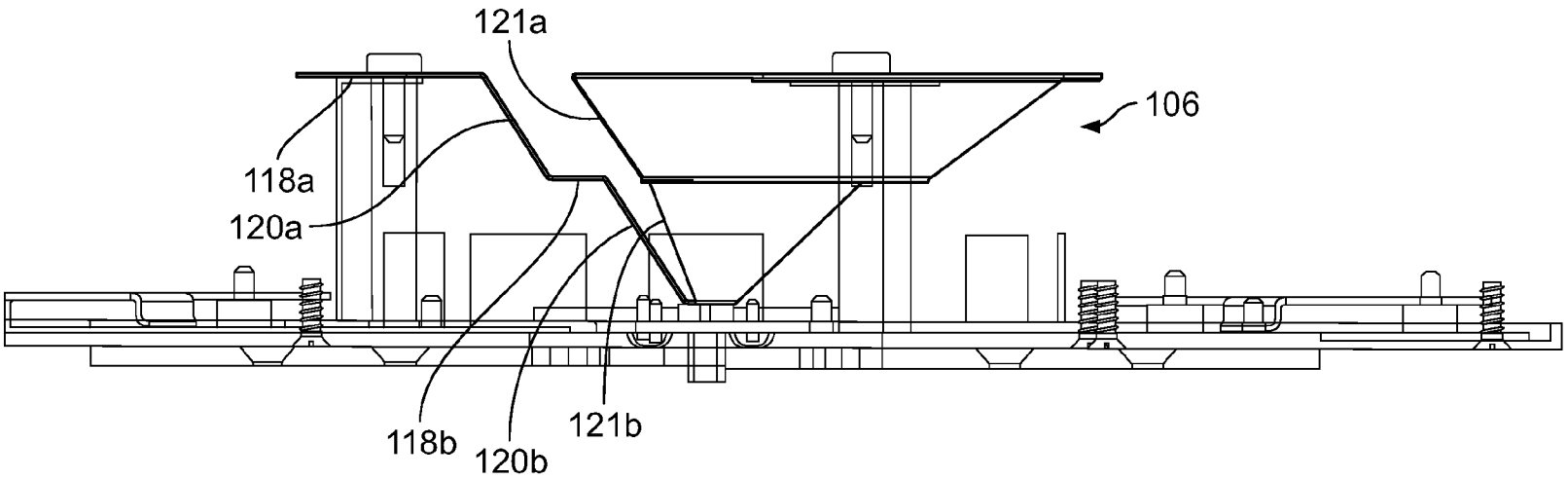

Further, as shown in FIGS. 4A to 4D, the tapering structure can include multiple steps 118 on a curve or flat side depending on the operating frequency ranges and height of the radiator element 106. The multiple steps 118 are configured for further gradually changing impedance to broaden bandwidth. As shown in FIG. 4D, the electrical length with steps 118 (the length of the sides 120*a*, 120*b* plus length of the steps 118*a*, 118*b*) is longer than an electrical length without steps (on the length of the sides 121*a*, 121*b*) thereby enabling the radiator element 106 to have a lower profile with a longer electrical length to reach lower resonant frequencies. Although the example embodiment shown in FIGS. 2 to 5 includes only two steps on each radiator petal side, other embodiments may include more or less than two steps on the radiator petal side (e.g., one, three, four, or more than four, etc.) depending on the height and frequency the radiator requires. For some example embodiments, the steps can be removed when a relatively higher antenna is acceptable. In such embodiments, the radiator petals 116 may have sloping sides, curved edges, convex sides, etc.

Figure 5:
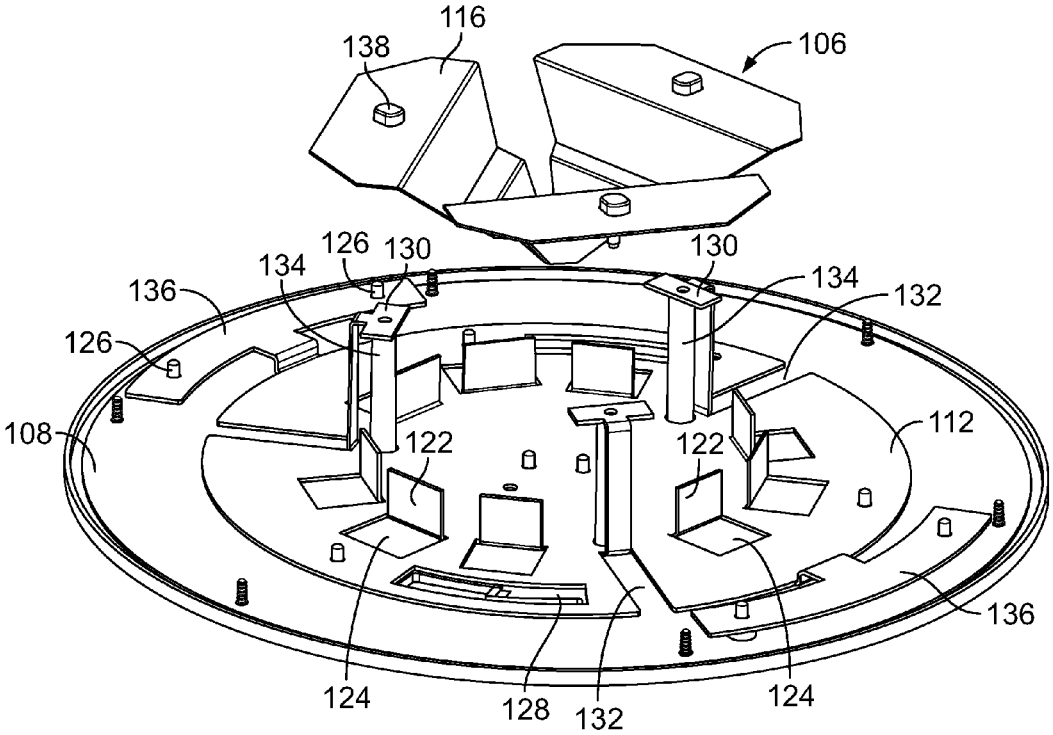
FIG. 5 is an exploded perspective view showing the radiator element spaced apart and removed from the base of the omnidirectional SISO antenna shown in FIG. 3.

FIG. 5 is an exploded perspective view of the antenna 100 shown in FIG. 3. As shown in FIG. 5, the ground plate 112 is a generally planar or flat surface having ground flaps 122 to reduce inductance and improve the matching of the high band. The ground flaps 122 may extend (e.g., stamped and integrally formed, etc.) from the ground plate 112. For example, the ground flaps 122 may be stamped from the ground plate 112 and then bent at an angle (e.g., an acute angle, perpendicularly, an obtuse angle, etc.) relative to the ground plate 112, thus leaving openings or holes 124 in the ground plate 112. The number of the ground flaps 122 may depend on the bandwidth needed for the antenna 100. The locations and sizes of the ground flaps 122 may be changed to optimize or improve performance of the antenna 100. Thus, the locations and sizes of the ground flaps 122 may depend on the desired performance.

As shown in FIG. 5, the ground plate 112 may further include one or more extended ground studs 136. For example, the ground plate 112 in FIG. 5 is shown with two extended ground studs 136 although other embodiments may include more or less than two extended ground studs. The ground studs 136 extend the bandwidth of the lower band.

Further, the ground plate 112 may include fasteners or connectors 126 (e.g., plastic rivets, heat staking, bolt and nuts, etc.) to connect the ground plate 112 to the base assembly 108. As shown in FIG. 5, the ground plate 112 may define additional holes 128 configured to provide space for accommodating a mounting kit for mounting the base assembly 108 (e.g., kit twist and/or lock features, etc.).

The example embodiment shown in FIG. 5 also includes three shorting legs 130 extended (e.g., stamped and integrally formed, etc.) from the ground plate 112 for electrically coupling to the three radiator petals 116 of the exemplary radiator 106 by some fastening methods (e.g., soldering, proximity coupling, fastening, welding, bolt and nuts, etc.). For example, the shorting legs 130 may be stamped from the ground plate 112 and then bent at an angle (e.g., an acute angle, perpendicularly, an obtuse angle, etc.) relative to the ground plate 112, leaving notches 132 on the ground plate 112.

Further, three plastic holders 134 may be configured to couple with three respective shorting legs 130 to secure the radiator 106 in place. The example shorting legs 130 each having a T-shape with its top part bent at an angle (e.g., an acute angle, perpendicularly, an obtuse angle, etc.) relative to the rest of its main part so that the top part can be in contact with the top surface of each supporting plastic holder 134. Further, three fasteners or connectors 138 (e.g., plastic snap fit nuts, plastic rivets, heat staking, etc.) may be included to secure the top radiator petals 116 to the three ground plane shorting legs 130 and the three plastic holders 134 through those contacts. Such a structure can provide sufficient mechanical support to the radiator 106 with a required height. Accordingly, the radiator 106 with low profile features can be positioned to have good omnidirectional radiation patterns without a separate shorting leg which is usually required for most conventional shorted inverted cone antenna designs.

Similarly, although the example shows three shorting legs 130, three holders 134, and three fasteners or connectors 138, alternative embodiments may include more or less than three shorting legs, holders, and/or fasteners. It may be preferable to have the same number of radiator petals, shorting legs, holders, and/or fasteners for a better more convenient securing through the one-to-one relationships, but this is not required for all embodiments.

Additionally, two "T-shaped" ground studs 136 extend from the ground plate 112 to thereby extend the electrical length of the ground plate 112 and broaden the low frequency bandwidth of the antenna 100. Antennas having such "T-shaped" ground studs extending from ground plates can significantly load down the resonant frequency at low bands and broaden bandwidths without significantly compromising good radiation patterns. Notably, it is usually very difficult to load down the resonant frequency at the low band operating frequency range of radiators with low profile requirements.

The "T-shaped" ground studs 136 may be as flat as the ground plate 112. Alternatively, as shown in FIG. 5, the "T-shaped" ground studs 136 are slightly lifted up from the ground plate 112 in the consideration of reducing the effect of the antenna performance when the antenna 100 is placed on a metallic surface (e.g., RF performance when the antenna is installed to a ceiling, in which case, the ground plate will be close to a metallic ceiling, etc.). Although FIG. 5 shows two "T-shaped" ground studs 136, alternative embodiments may include more or less than two ground studs and/or different configured (e.g., differently shaped or sized, etc.) ground studs.

The radiator element 106 may be fed from the bottom by a cable soldered to the center 114. As shown in FIGS. 6A to 6C, the radiator 106 may be fed from the bottom of the ground plate 112 (broadly, a ground element or member) via a coaxial cable 142 (broadly, a feed) and a cable bracket 144. The cable bracket 144 may be configured or designed to provide stable low PIM performance. By using the cable bracket 114, it may be a relatively simple process to solder the cable braid 140 of the coaxial cable 142.

As shown in FIGS. 6A to 6C, an electrical insulator or dielectric material 146 is configured to be positioned between the cable bracket 144 and the ground plate 112. Accordingly, the electrical insulator 146 separates and prevents direct electrical galvanic contact of the antenna ground plate 112 with the cable bracket 144. The cable bracket 144 is thus electrically insulated from the antenna ground plate 112 via the thin electrical insulator 146.

As shown in FIG. 6B, the coaxial cable 142 and the radiator element 106 are on opposite sides of the ground plate 112. The cable bracket 144 and the ground plate may be made of any suitable material, such as, for example, an electrically-conductive metal, electrically-conductive alloy, aluminum, brass, printed electrically-conductive ink on a dielectric, etc. By way of example only, the cable bracket 144 may be made of brass, while the ground plate 112 may be made of aluminum.

As shown in FIG. 6B, the cable bracket 144 is a generally planar or flat surface having two tabs 148*a*, 148*b* extending (e.g., stamped and integrally formed, etc.) from a bottom surface of the cable bracket 144. For example, the tabs 148*a*, 148*b* may be stamped from the cable bracket 144 and then bent at an angle (e.g., an acute angle, perpendicularly, etc.) relative to a bottom surface of the cable bracket 144. The cable bracket 144 and its tabs 148*a*, 148*b* may be configured to allow a cable braid of a coaxial cable to be soldered to the tabs 148*a*, 148*b* such that the cable braid does not galvanically contact the ground plate 112. The cable bracket 144 and its tabs 148*a*, 148*b* may also allow for better soldering consistency. The cable braid 140 may thus be soldered to the tabs 148*a*, 148*b* without any direct galvanic contact between the cable braid 140 and the ground plate 112. Accordingly, the cable bracket 144 and its tabs 148*a*, 148*b* may thus prevent direct galvanic contact surface between the cable braid 140 and the ground plate 112 or reduce galvanic contact overall.

The tabs 148*a*, 148*b* are configured to have relatively small surfaces that will physically contact or touch the cable braid 140. This not only helps to achieve a stable low PIM, but may also reduce the risk of intermittent soldering wetting of the cable braid 140 (FIG. 6A) to the cable bracket 144. Further, the cable bracket 144 has a large surface (e.g., the upper and lower flat or planar surfaces, etc.) that allows proximity grounding or ground proximity coupling of the cable bracket 144 to the ground plate 112, which are separated by the electrical insulator 146 (e.g., a thin layer of dielectric material, etc.) as shown in FIG. 6A. The relatively large surface area of the cable bracket 144 may help ensure sufficient coupling is created to have proximity grounding between the cable bracket 144 and the ground plate 112. The cable bracket 144 may be coupled to the ground plate 112 with plastic fasteners or connectors 150, such as plastic rivets, heat staking, bolt and nuts, etc. By way of example, a diameter of the cable bracket ground surface may be about 85 millimeters (mm) in an exemplary embodiment. The insulator 146 may have a thickness that falls within a range from about 0.1 mm to 0.2 mm (e.g., 0.1 mm, 0.15 mm, 0.2 mm, etc.).

The cable bracket 144 may define one or more holes 152 configured for fasteners (e.g., heat staking, plastic rivets, bolt and nuts, etc.) to pass through, and secure both the cable bracket 144 and ground plate 112 to the base 108.

Furthermore, proximity coupling methods (e.g., plastic fasteners, heat staking, bolt and nuts, etc.) between the radiator petals 116 and the corresponding shorting legs 130 may provide the cleanest PIM source because such a configuration does not include galvanic contact between the radiator 106 and the ground plate 112.

FIGS. 7A to 7C illustrate another example for feeding an antenna using press fit feed thorough according to one or more aspects of the present disclosure. As shown in FIGS. 7A to 7C, the cable braid 140 may be soldered to the feed through 154. The feed through 154 is press fit to the ground plate 112 with the cable braid 140 flush against or with the top surface 156 of the feed through 154. Alternatively, the cable braid 140 can be crimped via an additional ferule when the low PIM performance is not required. Thus, another method of feeding a radiator element (e.g., radiator element 106, etc.) with a simple process is disclosed herein.

FIGS. 8 to 26 provide results measured for a prototype Low PIM Low profile Long Term Evolution (LTE) SISO antenna having the ground assembly shown in FIGS. 6A to 6C. These analysis results are provided only for purposes of illustration and not for purposes of limitation as other exemplary embodiments may be configured differently and/or have different performances.

FIG. 8 is an exemplary line graph of voltage standing wave ratio (VSWR) versus frequency measured for a prototype antenna as shown in FIGS. 1A through 3 and FIGS. 6A through 6C. Generally, FIG. 8 shows that the prototype antenna is operable with good voltage standing wave ratio (VSWR), e.g., VSWR less than 2 for frequencies 698 MHz to 3 GHz, etc.

FIGS. 9 through 24 illustrate radiation patterns (azimuth plane, Phi 0° plane, and Phi 90° plane) measured for a prototype antenna as shown in FIGS. 1A through 3 and FIGS. 6A through 6C at frequencies of 698 megahertz (MHz), 746 MHz, 806 MHz, 824 MHz, 880 MHz, 960 MHz, 1710 MHz, 1740 MHz, 1880 MHz, 1950 MHz, 2110 MHz, 2170 MHz, 2305 MHz, 2412 MHz, 2665.5 MHz, and 2700 MHz, respectively. Generally, FIGS. 9 through 24 show the omnidirectional radiation pattern and good efficiency of the antenna 100.

FIGS. 25 and 26 are exemplary line graphs of intermodulation level (IM) in decibels relative to carrier (dBc) versus frequency in megahertz (MHz) showing PIM (IM3) performance for two transmitted carriers (20 W each) measured for a prototype antenna as shown in FIGS. 1A through 3 and FIGS. 6A through 6C at respective frequencies of 728 MHz to 757 MHz and at 1930 MHz to 1990 MHz. As shown, the prototype antenna has low PIM performance (e.g., less than −150 dBc, etc.) at low band. Generally, these results show that the prototype antenna had good PIM performance, e.g., at 728 MHz to 757 MHz and 1930 MHz to 1990 MHz, etc., even though it is usually more difficult to achieve reasonable PIM level at lower frequency bands.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An omnidirectional broadband antenna comprising:

a radiator element having a single piece construction including a cone shape defined by multiple petals separated from each other by a gap or spaced distance therebetween and integrally joined to each other at about a center of the radiator element, each of the multiple petals having a stepped configuration;

a ground element; and multiple shorting legs extended from the ground element for electrically coupling to and mechanically supporting the multiple petals.

2. The omnidirectional broadband antenna of claim 1, wherein the ground element includes one or more extended ground studs integrally formed from and extending above the ground element.

3. The omnidirectional broadband antenna of claim 1, wherein the multiple petals are integrally formed from a same single sheet of material such that the multiple petals are integrally connected to each other at about the center of the radiator element without having to separately weld or join the multiple petals to each other.

4. The omnidirectional broadband antenna of claim 1, wherein each of the multiple petals has the stepped configuration for electrically lengthening the radiator element.

5. The omnidirectional broadband antenna of claim 1, wherein each of the multiple petals comprises one or more steps configured for electrically lengthening the radiator element and gradually changing impedance to broaden bandwidth.

6. The omnidirectional broadband antenna of claim 1, wherein the single piece construction is a central symmetrical structure configured for improving omnidirectional radiation patterns of the radiator element and defined by the multiple petals and the gaps or spaced distances between the multiple petals.

7. The omnidirectional broadband antenna of claim 1, wherein the number of the multiple shorting legs is the same as the number of multiple petals, and wherein each of the multiple shorting legs is configured to electrically couple to and mechanically support a corresponding one of the multiple petals.

8. The omnidirectional broadband antenna of claim 1, further comprising multiple holders configured to couple with the multiple shorting legs to further secure the radiator element in place.

9. The omnidirectional broadband antenna of claim 1, wherein the ground element includes one or more ground flaps to reduce inductance and improve matching of high band that are integrally formed from the ground element such that the ground flaps extend from the ground element at an angle relative to the ground element thereby leaving corresponding openings in the ground element.

10. The omnidirectional broadband antenna of claim 1, wherein:

the multiple petals includes three petals that are separated from each other by a gap or spaced distance therebetween and that are integrally joined to each other at about the center of the radiator element to thereby define the cone shape of the radiator element; and the omnidirectional broadband antenna is operable with a passive intermodulation (IM3) less than −150 decibels relative to carrier (dBc) from about 698 megahertz to about 2700 megahertz.

11. A method of constructing a radiator element for an omnidirectional broadband antenna, the method comprising:

stamping a single piece sheet of metal into multiple petals that are separated from each other by a gap or spaced distance therebetween and that are integrally joined to each other at about a center of the stamped single piece sheet of metal;

forming each of the multiple petals so as to form a central symmetrical cone shape defined by the multiple petals and the gaps or spaced distances between the multiple petals and such that each of the multiple petals has a stepped configuration; and mechanically supporting the multiple petals using multiple shorting legs extended from a ground element of the omnidirectional broadband antenna.

12. The method of claim 11, wherein forming each of the multiple petals comprises bending the multiple petals such that each of the multiple petals has the stepped configuration for electrically lengthening the radiator element.

13. The method of claim 11, wherein forming each of the multiple petals comprises bending the multiple petals such that each of the multiple petals includes one or more steps configured for electrically lengthening the radiator element and gradually changing impedance to broaden bandwidth.

14. The method of claim 11, wherein the multiple petals are integrally connected to each other at a center of the radiator element and remain integrally connected to each other during and after the stamping and forming without having to weld or join the multiple petals to each other.

15. An omnidirectional broadband single-input single-output multiband antenna comprising:

a radiator element having a single piece construction including a cone shape defined by multiple petals that are separated from each other by a gap or spaced distance therebetween and that are integrally connected to each other at a center of the radiator element, each of the multiple petals having a stepped configuration for electrically lengthening the radiator element;

a ground element to which the radiator element is shorted; and multiple shorting legs extended from the ground element for electrically coupling to and mechanically supporting the multiple petals.

16. The omnidirectional broadband single-input single-output multiband antenna of claim 15, wherein:

each of the multiple petals comprises one or more steps configured for electrically lengthening the radiator element and gradually changing impedance to broaden bandwidth; and/or the single piece construction is a central symmetrical structure configured for improving omnidirectional radiation patterns of the radiator element.

17. The omnidirectional broadband single-input single-output multiband antenna of claim 15, wherein the ground element includes one or more ground flaps to reduce inductance and improve matching of high band that are integrally formed from the ground element such that the ground flaps extend from the ground element at an angle relative to the ground element thereby leaving corresponding openings in the ground element.

* * * * *